US011391182B2

(12) United States Patent
Kim et al.

(10) Patent No.: US 11,391,182 B2
(45) Date of Patent: Jul. 19, 2022

(54) EXTERNAL REACTOR VESSEL COOLING AND ELECTRIC POWER GENERATION SYSTEM

(71) Applicants: KOREA ATOMIC ENERGY RESEARCH INSTITUTE, Daejeon (KR); KING ABDULLAH CITY FOR ATOMIC AND RENEWABLE ENERGY, Riyadh (SA)

(72) Inventors: Youngin Kim, Daejeon (KR); Youngmin Bae, Daejeon (KR); Hunsik Han, Sejong (KR); Cheongbong Chang, Daejeon (KR); Junewoo Kee, Pohang-si (KR); Minkyu Lee, Daejeon (KR); Bonghyun Cho, Daejeon (KR); Kisun Park, Icheon-si (KR)

(73) Assignees: KOREA ATOMIC ENERGY RESEARCH INSTITUTE, Daejeon (KR); KING ABDULLAH CITY FOR ATOMIC AND RENEWABLE ENERGY, Riyadh (SA)

( * ) Notice: Subject to any disclaimer, the term of this patent is extended or adjusted under 35 U.S.C. 154(b) by 0 days.

(21) Appl. No.: 16/613,223

(22) PCT Filed: May 14, 2018

(86) PCT No.: PCT/KR2018/005482
§ 371 (c)(1),
(2) Date: Nov. 13, 2019

(87) PCT Pub. No.: WO2018/212522
PCT Pub. Date: Nov. 22, 2018

(65) Prior Publication Data

US 2020/0072087 A1 Mar. 5, 2020

(30) Foreign Application Priority Data

May 17, 2017 (KR) ..... 10-2017-0059996

(51) Int. Cl.
*F01K 3/18* (2006.01)
*F01K 9/00* (2006.01)
(Continued)

(52) U.S. Cl.
CPC ..... *F01K 3/181* (2013.01); *F01K 9/003* (2013.01); *F01K 11/02* (2013.01); *G21C 15/16* (2013.01);
(Continued)

(58) Field of Classification Search
CPC .. G21D 5/00; G21D 5/08; G21D 5/10; G21D 5/12; G21D 5/14; G21D 5/02; G21D 5/04;
(Continued)

(56) References Cited

U.S. PATENT DOCUMENTS 2,936,273 A * 5/1960 Untermyer ..... G21C 1/08 376/207
3,213,833 A * 10/1965 Cunningham ..... F22B 1/023 122/34
(Continued)

FOREIGN PATENT DOCUMENTS

EP 0993000 A2 * 4/2000 ..... G21C 15/18
EP 2405444 B1 2/2016
(Continued)

OTHER PUBLICATIONS

International Search Report dated Aug. 16, 2018 issued in PCT/KR2018/005482.

*Primary Examiner* — Mark A Laurenzi
*Assistant Examiner* — Xiaoting Hu
(74) *Attorney, Agent, or Firm* — Scully Scott Murphy and Presser

(57) ABSTRACT

An external reactor vessel cooling and electric power generation system according to the present invention includes
(Continued)

an external reactor vessel cooling section formed to enclose at least part of a reactor vessel with small-scale facilities so as to cool heat discharged from the reactor vessel, a power production section including a small turbine and a small generator to generate electric energy using a fluid that receives heat from the external reactor vessel cooling section, a condensation heat exchange section 140 to perform a heat exchange of the fluid discharged after operating the small turbine, and condense the fluid to generate condensed water, and a condensed water storage section to collect therein the condensed water generated in the condensation heat exchange section, wherein the fluid is phase-changed into gas by the heat received from the reactor vessel. The external reactor vessel cooling and electric power generation system according to the present invention can continuously operate even during an accident as well as during a normal operation to cool the reactor vessel and produce emergency power, thereby enhancing system reliability. The external reactor vessel cooling and electric power generation system according to the present invention can easily apply safety class or seismic design using small-scale facilities, and its reliability can be improved owing to applying the safety class or seismic design.

26 Claims, 15 Drawing Sheets

(51) Int. Cl.

| | |
|---|---|
| ***F01K 11/02*** | (2006.01) |
| ***G21C 15/16*** | (2006.01) |
| ***G21D 1/00*** | (2006.01) |
| ***G21D 5/12*** | (2006.01) |
| ***G21D 3/04*** | (2006.01) |

(52) U.S. Cl.
CPC ..... *G21D 1/006* (2013.01); *G21D 3/04* (2013.01); *G21D 5/12* (2013.01)

(58) Field of Classification Search
CPC ..... G21D 5/06; G21D 1/006; G21D 1/02; G21D 3/04; G21D 3/06; F01K 3/181; F01K 9/003; F01K 11/02; F01K 13/00; G21C 15/18; G21C 15/182; G21C 15/185; G21C 9/016; G21C 15/00; G21C 15/12; G21C 15/16; G21C 1/028; G21C 1/03; F22B 1/162; F22B 1/1823
See application file for complete search history.

(56) References Cited

U.S. PATENT DOCUMENTS

| | | | | | |
|---|---|---|---|---|---|
| 5,026,517 | A * | 6/1991 | Menken | G21C 3/07 | 376/438 |
| 5,120,494 | A * | 6/1992 | Nazareno | F04D 7/08 | 376/282 |
| 5,268,939 | A * | 12/1993 | Tang | F01K 9/04 | 376/210 |
| 5,825,838 | A * | 10/1998 | Park | G21C 9/016 | 376/299 |
| 7,975,484 | B1 * | 7/2011 | Burns | F01K 9/023 | 60/686 |
| 2010/0260302 | A1 * | 10/2010 | Pelisson | G21C 15/18 | 376/282 |
| 2012/0263270 | A1 * | 10/2012 | Malloy | G21D 1/006 | 376/396 |
| 2012/0294408 | A1 | 11/2012 | Reyes, Jr. et al. | | |
| 2013/0104548 | A1 * | 5/2013 | Kontomaris | C09K 5/048 | 60/651 |
| 2013/0223579 | A1 * | 8/2013 | Allen | G21C 7/14 | 376/219 |
| 2014/0334590 | A1 * | 11/2014 | Kim | G21C 13/02 | 376/282 |
| 2016/0141054 | A1 * | 5/2016 | No | G21C 9/016 | 376/280 |
| 2016/0231059 | A1 * | 8/2016 | Choi | G21D 5/12 | |

FOREIGN PATENT DOCUMENTS

| | | | |
|---|---|---|---|
| JP | 2014-029303 | A | 2/2014 |
| JP | 2017-044647 | A | 3/2017 |
| KR | 101242743 | B1 | 3/2013 |
| KR | 101520740 | B1 | 5/2015 |
| KR | 20170001326 | A | 1/2017 |

* cited by examiner

EXTERNAL REACTOR VESSEL COOLING AND ELECTRIC POWER GENERATION SYSTEM

CROSS-REFERENCE TO RELATED APPLICATION

Pursuant to 35 U.S.C. § 119(a), this application claims the benefit of the earlier filing date and the right of priority to Korean Patent Applications No. 10-2017-0059996, filed on May 15, 2017, the contents of which are incorporated by reference herein in their entirety.

BACKGROUND

1. Technical Field

The present invention relates to a nuclear reactor vessel cooling method, and more particularly, a power generation using heat of a reactor vessel during a normal operation, an emergency power generation using heat of the reactor vessel during an accident, and cooling of the reactor vessel.

2. Description of the Related Art

Nuclear reactors are divided according to installation positions of major components (steam generator, pressurizer, pump, etc.) into loop type reactors (e.g., commercial reactors: domestic) in which such major components are installed outside a reactor vessel and integral reactors (e.g., SMART reactors: domestic) in which the major components are installed inside a reactor vessel.

Nuclear power plants are also divided into active plants and passive plants depending on a way of implementing a safety system. An active plant is a plant using an active component such as a pump operated by electric power of an emergency diesel generator (EDG) or the like to drive a safety system, and a passive plant is a plant using a passive component operated by passive power such as gravity, gas pressure or the like to drive the safety system.

A passive safety system in a passive plant may maintain the reactor in a safe manner only with a natural force built in the system without an operator action or an AC power source of safety class such as an emergency diesel generator for more than a period of time (72 hours) required by regulatory requirements in the event of an accident, After 72 hours, using an operator action and a non-safety systems might be allowed to maintain the function of the safety systems and an emergency DC power source(battery).

Unlike a general thermal power plant where heat generation is stopped when fuel supply is stopped, a reactor in a nuclear power plant generates residual heat from a reactor core for a significant period of time by a fission product produced and accumulated during a normal operation even when a fission reaction is stopped in the reactor core. Accordingly, a variety of safety systems for removing the residual heat of the core during an accident are installed in the nuclear power plant.

In case of an active nuclear power plant (Conventional Nuclear Power Plant of Korea), a plurality of emergency diesel generators are provided in preparation for a case of interruption of electric power supply from the inside or outside at the time of an accident, and most active nuclear power plants use a pump to circulate cooling water, and thus a large-capacity emergency AC power source (a diesel generator) is provided due to the high power requirements of those active components. An operator action allowance time in an active nuclear power plant is estimated about 30 minutes.

In order to exclude active components such as a pump and the like that require a large amount of electricity, a passive force such as gas pressure or gravity is introduced in a passive nuclear reactor (U.S. Westinghouse AP1000, Korean SMART) that has been developed or is being developed to enhance the safety of the nuclear power plant, and thus a large amount of power is not required other than small components such as a valve, which is essentially required for the operation of a passive safety system. However, to enhance the safety in a passive nuclear power plant, an operator action allowance time is drastically extended from 30 minutes to 72 hours or longer, and an emergency active power source (diesel generator) is excluded, and an emergency DC power source (battery) is adopted. And thus the emergency DC power source should be maintained for more than 72 hours. Therefore, the emergency power source capacity required per unit time in a passive nuclear power plant is relatively small compared to an active nuclear power plant, but it is very large in terms of the battery capacity because the emergency power should be supplied for 72 hours or more.

In the other hand, a residual heat removal system (auxiliary feed water system or passive residual heat removal system) is employed as a system for removing the heat of a reactor coolant system (the sensible heat of the reactor coolant system and the residual heat of the core) using a residual heat removal heat exchanger connected to a primary system or secondary system when an accident occurs in various nuclear power plants including an integral reactor. (AP1000: U.S. Westinghouse, commercial loop type nuclear power plant and SMART reactor: Korea)

Furthermore, a safety injection system is employed as a system for directly injecting cooling water into the reactor coolant system in case of a loss-of-coolant accident to maintain a water level of the reactor core and removing the heat of the reactor coolant system (the sensible heat of the reactor coolant system and the residual heat of the core) using the injected cooling water. (AP1000: U.S. Westinghouse, commercial loop type and SMART reactor: Korea)

In addition, a reactor containment cooling system or spray system is a system for condensing steam using cooling or spraying to suppress a pressure rise when a pressure inside the reactor containment rises due to an accident such as a loss-of-coolant accident or a steam-line-break accident. Additionally, there are a method of directly spraying cooling water into the reactor containment (commercial loop type reactor: Korea), a method of inducing steam discharged in the reactor containment into a suppression tank (commercial boiling water reactor), a method of using a heat exchanger installed inside or outside the reactor containment (reinforced concrete containment building) (APR+: Korea), a method of using a surface of the steel containment vessel as a heat exchanger (AP1000: U.S. Westinghouse), or the like.

As such, the nuclear power plant is provided with various safety systems, each of which consists of a plurality of trains of two or more trains, such as the residual heat removal system and the safety injection system for protecting the reactor core by cooling the reactor coolant system (including the reactor vessel) during an accident. However, in recent years, there has been a growing demand for safety enhancement of nuclear power plants due to the impact of Fukushima nuclear power plant (boiling water reactor) accident and the like, and thus there is a rising demand for safety facilities against a severe accident such as an external reactor vessel cooling system even in a pressurized water reactor (PWR) with a very low risk of leakage of large amounts of radioactive materials due to employing a very large-internal-volume nuclear reactor containment.

In detail, the nuclear power plant is provided with various safety facilities for relieving accidents upon an occurrence of an accident. In addition, each safety facility consists of redundant trains, and probability that all trains fail simultaneously is very low. However, as public demands for safety of nuclear power plants increase, safety facilities have been enhanced in preparation of severe accidents even with very low probability of occurrence.

The external reactor vessel cooling system is a system provided to cool the outside of reactor vessel during core meltdown to prevent damage of the reactor vessel, assuming that a serious damage occurs in the core cooling function and a severe accident that the core is melted occurs since various safety facilities do not adequately perform functions due to multiple failure causes at the time of an accident. (AP1000 Westinghouse of USA)

When the reactor vessel is damaged, a large amount of radioactive materials may be discharged into a reactor building, and internal pressure of the reactor building may rise due to an large amount of steam generated by corium (melted core)-water reaction and gas generated by the corium-concrete reaction. The reactor building serves as a final barrier to prevent the radioactive material from being discharged into an external environment during an accident. If the reactor building is damaged due to an increase in internal pressure, a large amount of radioactive materials may be released to the external environment. Therefore, the external reactor vessel cooling system performs a very important function of suppressing radioactive materials from being discharged into the reactor containment and the increase of the internal pressure during a severe accident to prevent radioactive materials from being discharged into an external environment.

The external reactor vessel cooling system which is adopted in many countries is a system in which cooling water is filled in the reactor cavity located at a lower part of the reactor vessel and the cooling water is introduced into the cooling flow path in a space between the thermal insulation material and the reactor vessel and then steam is discharged to an upper part of the cooling flow path. In addition, a method of injecting a liquid metal at the time of an accident to mitigate the critical heat flux phenomenon, a method of pressurized cooling water to induce single phase heat transfer, a method of modifying a surface of the external reactor vessel to increase the heat transfer efficiency, a method of forming a forced flow, and the like, may be taken into consideration.

In the related art external reactor vessel cooling system, since a thermal insulation material has to perform an appropriate thermal insulation function during a normal operation of the nuclear power plant, a flow path is sealed such that inlet and outlet flow paths formed in the thermal insulating material must be properly opened in a timely manner at the time of an accident. Also, a time delay occurs to fill the reactor cavity, and the heat removal ability may be reduced due to a critical heat flux phenomenon or the like while evaporating cooling water to form a steam layer on the external reactor vessel.

In addition, there is also a research on an external reactor cooling method using a liquid metal, but the liquid metal method has difficulties in the maintenance of the liquid metal. In addition, an external reactor cooling method in a pressurization manner has difficulties in the application of a natural circulation flow, and a method of modifying a surface of a reactor vessel has difficulties in the fabrication and maintenance of the surface, and a forced flow method has a disadvantage in that it must be supplied with electric power.

In addition, since the external reactor vessel cooling system is operated by an operator action at the time of an accident, various instruments and components for monitoring the accident are required for the operation, and probability that a system in a standby mode fails to operate at the time of an accident is higher than probability that a system being operated is stopped to operate at the time of an accident.

Thus, the present invention proposes an external reactor vessel cooling and electric power generation system, in which a large-scale turbine power generation facility in the related art is maintained almost same design, and a small-scale power generation facility is additionally installed to receive heat discharged from the reactor vessel during a normal operation or during an accident of the nuclear power plant and thus produce electricity.

SUMMARY

One aspect of the present invention is to provide an external reactor vessel cooling and electric power generation system having improved system reliability in which safety class or seismic design is easily applicable, and the reactor vessel cooling is carried out while continuously operating during an accident as well as during a normal operation to produce emergency power.

Another aspect of the present invention is to provide an external reactor vessel cooling and electric power generation system having improved safety by removing residual heat of a predetermined scale or more during an accident as well as a normal operation.

Another aspect of the present invention is to provide a nuclear power plant with improved economic efficiency and safety due to downsizing and reliability enhancement of an emergency power system.

Technical Solution

An external reactor vessel cooling and electric power generation system according to the present invention may include a reactor vessel, an external reactor vessel cooling section formed to enclose at least part of the reactor vessel so as to cool heat discharged from the reactor vessel, a power production section including a small turbine and a small generator to generate electric energy using a fluid that receives heat from the external reactor vessel cooling section, a condensation heat exchange section to perform a heat exchange of the fluid discharged after operating the small turbine, and condense the fluid to generate condensed water, and a condensed water storage section to collect therein the condensed water generated in the condensation heat exchange section, wherein the fluid receiving the heat from the reactor vessel may be circulated.

In an embodiment, the condensed water in the condensed water storage section may be circulated through the external reactor vessel cooling section, the power production section, and the condensation heat exchange section, and the fluid may be phase-changed into gas by the heat received from the reactor vessel.

In an embodiment, the system may further include an evaporation section connected to the external reactor vessel cooling section, to cause a heat exchange between the fluid inside the external reactor vessel cooling section and the condensed water of the condensed water storage section. The system may further include a first circulation part defined between the external reactor vessel cooling section and the evaporation section such that a fluid flows therealong, and a second circulation part defined sequentially along the evaporation section, the power production section, the condensation heat exchange section, and the condensed water storage section, such that a fluid flows therealong.

In an embodiment, the first circulation part may be circulated by a single-phase fluid.

In an embodiment, the power generation system may be operated during a normal operation of a nuclear power plant and during an accident of the nuclear power plant to produce electric power. The electric power generated during the normal operation of the nuclear power plant may be charged in an internal/external electric power system and an emergency battery. Also, the electric power charged in the emergency battery may be supplied as an emergency power source during the accident of the nuclear power plant.

In an embodiment, the electric power generated during the accident of the nuclear power plant may be supplied as an emergency power source of the nuclear power plant.

In an embodiment, the emergency power source may be used as power for operating a safety system of the nuclear power plant during the accident of the nuclear power plant, opening and closing a valve for the operation of the safety system, monitoring the safety system, or operating the external reactor vessel cooling and electric power generation system.

In an embodiment, seismic design of seismic categories I, II or III may be applied, and safety classes 1, 2 or 3 may be applied.

In an embodiment, the external reactor vessel cooling section may be provided with a discharge pipe that connects the external reactor vessel cooling section and the power production section to each other such that the fluid of the external reactor vessel cooling section is applied to the power production section.

In an embodiment, the discharge pipe may be provided with a first discharge portion through which at least part of the fluid excessively supplied to the power production section bypasses the small turbine and the small generator.

In an embodiment, the discharge pipe may further be provided with a liquid-gas separator that is connected to the discharge pipe such that only gas of the fluid is transferred to the power production section.

In an embodiment, the condensation heat exchange section may be provided with a motor or pump that supplies a cooling fluid to the condensation heat exchange section to exchange heat with the fluid. The cooling fluid may include air, pure water, seawater, or a mixture thereof.

In an embodiment, the condensed water storage section may be disposed below the condensation heat exchange section to collect the condensed water generated in the condensation heat exchange section.

In an embodiment, the condensed water storage section may be connected to the external reactor vessel cooling section through a pipe so that the condensed water is supplied to the external reactor vessel cooling section.

In an embodiment, the condensation heat exchange section or the condensed water storage section may be provided with an vent portion through which non-condensable gas accumulated in the condensation heat exchange section or in the condensed water storage section.

In an embodiment, the vent portion may remove the non-condensable gas by pressure drop of the Venturi using a fan or a steam flow rate.

In an embodiment, a shape of the external reactor vessel cooling section may include a cylindrical shape, a hemispherical shape, and a double vessel shape, or a combination thereof.

In an embodiment, a pipe may be connected to an in-containment refueling water storage tank (IRWST) such that refueling water is supplied to the external reactor vessel cooling section.

In an embodiment, the external reactor vessel cooling section may be provided with a second discharge portion through which the refueling water supplied from the IRWST is discharged.

In an embodiment, a coating member may further be provided to prevent corrosion of the reactor vessel, and a surface of the coating member may be chemically processed to increase a surface area.

In an embodiment, the system may further include a heat transfer member to smoothly transfer heat discharged from the reactor vessel and a surface of the heat transfer member may be chemically processed to increase a surface area.

In an embodiment, the system may further include a core catcher provided inside the external reactor vessel cooling section to receive and cool corium when the reactor vessel is damaged.

A loop or integral type nuclear power plant according to the present invention may include a reactor vessel, an external reactor vessel cooling section formed to enclose at least part of the reactor vessel so as to cool heat discharged from the reactor vessel, a power production section including a small turbine and a small generator to generate electric energy using a fluid that receives heat from the external reactor vessel cooling section, a condensation heat exchange section 140 to perform a heat exchange of the fluid discharged after operating the small turbine and condense the fluid to generate condensed water, and a condensed water storage section to collect therein the condensed water generated in the condensation heat exchange section, wherein the fluid receiving the heat from the reactor vessel may be circulated.

Advantageous Effects

The reactor external wall cooling and electric power generation system according to the present invention is configured to enclose the reactor vessel with small-scale facilities so as to produce electric power using heat transferred while cooling the reactor vessel.

A phase of fluid is changed from liquid to gas by the transferred heat, and the power production section is driven using the gas. The external reactor vessel cooling section, the power production section, and the condensation heat exchange section of the present invention may continuously operate even during an accident as well as during a normal operation, to cool the reactor vessel and produce emergency power, thereby improving system reliability. The system may easily employ a safety class or seismic design using small scale facilities, which may result in improving reliability of the nuclear power plant including cooling of an external wall of the reactor vessel.

The external reactor vessel cooling and electric power generation system according to the present invention can be designed to remove residual heat of a predetermined scale or more, which is generated in the reactor, by the external reactor vessel cooling section, and can continuously operate not only during a normal operation but also during an accident. This may result in lowering probability of operation failure during the accident, thereby improving safety of the nuclear power plant.

The nuclear power plant according to the present invention can have improved economic efficiency by way of reducing a size of an emergency power system using the external reactor vessel cooling and electric power generation system.

DETAILED DESCRIPTION OF THE EMBODIMENTS

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In describing the present invention, moreover, the detailed description will be omitted when a specific description for publicly known technologies to which the invention pertains is judged to obscure the gist of the present invention. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1A:
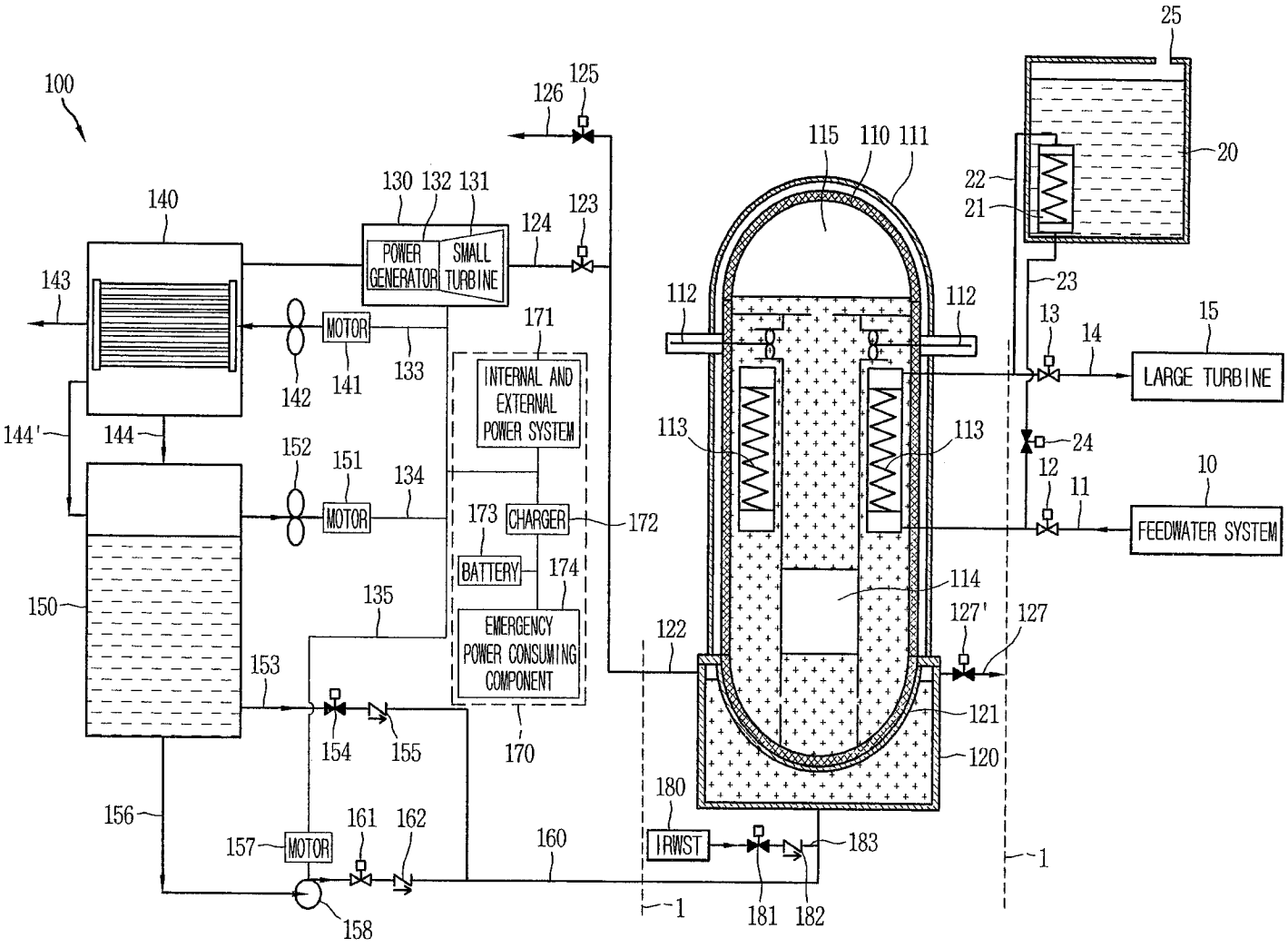
FIG. 1A is a conceptual view of an external reactor vessel cooling and electric power generation system in accordance with an embodiment of the present invention.

FIG. 1A is a conceptual view of an external reactor vessel cooling and electric power generation system 100 according to an embodiment of the present invention.

In the embodiment of the present invention, an insulating material 111 may be provided to surround a part of a reactor vessel 110, and a core 114 may be provided inside the reactor vessel 110. The core 114 refers to nuclear fuel. Electric power is produced by heat which is generated while nuclear fission is performed in the core 114.

When an accident occurs in a nuclear power plant, residual heat may be generated for a considerable period of time even when the core 114 is stopped because a control rod is inserted in the core 114. If it is assumed that various safety and non-safety systems do not work at the time of an accident of a nuclear power plant, cooling water inside the reactor vessel 110 may be lost to increase the temperature of the nuclear fuel, thereby causing a core meltdown phenomenon.

On the other hand, during a normal operation of the nuclear power plant, steam may be produced in the steam generator 113 by receiving heat from the reactor coolant system. The steam generator 113 may be a pressurized light water reactor. Further, the steam produced by the steam generator 113 may be steam that is phase-changed by receiving water through a main feedwater line 11 connected to a feedwater system 10 and an isolation valve 12. The steam produced by the steam generator 113 may be passed through a main steam line 14 connected to an isolation valve 13 and supplied to a large turbine 15 and a large generator (not shown) to produce electric power while fluid energy of the steam is converted into electric energy through mechanical energy.

In addition, a reactor coolant pump 112 may circulate a coolant filled in the reactor vessel 110. A pressurizer 115 provided inside the reactor vessel 110 may control pressure of the reactor coolant system.

In addition, a passive residual heat removal system including an emergency cooling water storage section 20 and a heat exchanger 21 may be provided therein, so that heat can also be discharged to the emergency cooling water storage section 20 by natural circulation due to a two-phase flow and opening and closing of a valve 24 during an accident. Further, when steam is generated while emergency cooling water is evaporated by heat transferred to the emergency cooling water storage section 20, the steam may be discharged through a steam discharge unit 25 such that the transferred heat can be discharged to the atmosphere.

The external reactor vessel cooling and electric power generation system 100 is in an operating state even during a normal operation. And then the external reactor vessel cooling system continues to operate during an accident. Heat is continuously transferred to the reactor vessel 110 due to residual heat generated in the core 114 until the temperature of the reactor vessel 110 is remarkably reduced to reach a safe state of the reactor vessel 110 during an accident. Accordingly, an operator action for the operation of the external reactor vessel cooling system, various measuring instruments and control systems, valve operation or pump start and opening and closing of a thermal insulation material which are needed in the related art may not be required, and thus the probability of operation failure of the external reactor vessel cooling and electric power generation system 100 is greatly reduced to improve the safety of the nuclear power plant.

In addition, since emergency electric power can be safely produced by the external reactor vessel cooling and electric power generation system 100 until the temperature of the reactor vessel is reduced to reach a safe state during an accident, the capacity of an emergency DC battery(emergency electric power source) can be decreased to improve the economic efficiency of the nuclear power plant and improve the reliability of an emergency power system of the nuclear power plant by securing an emergency power supply source of a safety system, thereby improving the safety of the nuclear power plant.

In detail, in case of a passive nuclear power plant, emergency power required during an accident is less than about 0.05% compared to the power generation capacity generated from the nuclear power plant during a normal operation. However, it is designed to use a battery for 72 hours or more, and thus a very large battery is required, having a disadvantage of increasing the cost. However, the external reactor vessel cooling and electric power generation system 100 may be configured to produce an appropriate level of emergency power using residual heat continuously generated from the core (an amount of residual heat generated is several % (initial shutdown) to 1/several % (after 72 hours subsequent to shutdown) compared to a normal amount of thermal power) even after the reactor is shut down upon an occurrence of an accident.

In addition, when power is produced using the external reactor vessel cooling and electric power generation system 100, the power production amount is about several tens kWe to several MWe, and the capacity is less than 1/several % compared to the feedwater system 10 and the large turbine 15 for a normal operation of the nuclear power plant. This system 100 has almost no influence on the operation of the nuclear power plant, and therefore, even when this system 100 fails during a normal operation. That is to say, this system 100 has a capacity less than 1/several %, so it has little effect on a nuclear power plant operation.

In addition, when power is produced using the external reactor vessel cooling and electric power generation system 100, it may be constructed in a small scale compared to the large-capacity feedwater system 10 and the large turbine 15 for producing normal power. Therefore, it is easy to apply seismic design and safety class, and cost increase is not so great due to small facilities even when the seismic design and safety class are applied.

Even in the event of an accident, the external reactor vessel cooling and electric power generation system can continue to operate as a normal operation without any additional valve operation, and therefore, during an accident, operation failure of valves, pumps, and etc. for operating the related art external reactor vessel cooling and electric power generation system, and probability of operation failure or malfunction due to errors of measuring instruments and control signals may be significantly reduced. Further, when a severe accident occurs and the external reactor vessel cooling section 120 and a power (electric power) production section 130 may do not work during the occurrence of the severe accident, a flow path through an in-containment refueling water storage tank (hereinafter, referred to as IRWST) 180 and a second discharge portion 127 is already formed, and therefore, smooth supply and discharge of cooling water may be enabled by a simple operation such as opening/closing of valves according to an operator action, such that the cooling water can be supplied well for cooling the reactor vessel 110.

Particularly, since an integral type reactor in which a connecting line for a measuring instrument or the like is not installed at a lower portion of the reactor vessel has a simple structure, it is facilitated to apply the external reactor vessel cooling and electric power generation system 100.

In addition, the external reactor vessel cooling and electric power generation system 100 may be utilized as additional residual heat removal means that plays a role of removing residual heat of the reactor core 114 during an accident.

Hereinafter, the external reactor vessel cooling and electric power generation system 100 according to the present invention will be described in detail.

A reactor vessel 110, an external reactor vessel cooling section 120 and an IRWST 180 may be provided inside a reactor building boundary 1. An insulating material 111 may additionally be provided on an external wall of the reactor vessel 110. The external reactor vessel cooling section 120 may be formed to enclose at least part of the reactor vessel 110. In addition, the external reactor vessel cooling section 120 may be formed to receive heat discharged from the reactor vessel 110 and cool the external wall of the reactor vessel 110.

On the other hand, a power production section 130, a condensation heat exchange section 140, and a condensed water storage section 150 are provided outside the reactor building boundary 1. The power production section 130 may supply power by being connected to motors 141, 151 and 157, an internal/external electric power system 171, a charger 172, an emergency power consuming device(emergency safety systems, main control room, and etc.) 174 and an emergency battery 173. However, some of those components illustrated as being installed outside the reactor building boundary 1 may alternatively be disposed inside the reactor building boundary 1 depending on arrangement characteristics of nuclear power plants.

The reactor vessel 110 may be a pressure vessel that circulates a reactor coolant therein, is provided with the core 114 therein, and is designed to withstand high pressure.

In addition, the external reactor vessel cooling section 120 may be formed to enclose the reactor vessel 110, and receive heat discharged from the reactor vessel 110 so as to cool the external wall of the reactor vessel 110 using a fluid which is subjected to phase change from liquid to gas.

In detail, the external reactor vessel cooling section 120 may be formed in a cylindrical shape. However, the shape of the external reactor vessel cooling section 120 is not limited to the cylindrical shape, but may alternatively include a hemispherical shape, a dual-container shape, or a combined shape thereof. In addition, the external reactor vessel cooling section 120 may further include a coating member 121 for preventing corrosion thereof. In this embodiment, the coating member 121 may have a surface modified in various ways and may be processed into an uneven shape (cooling fins) to increase a heat transfer surface area. Further, the coating member 121 may further include a heat transfer member (not shown) whose surface is chemically processed to increase a surface area so as to improve heat transfer efficiency. That is, the surfaces of the coating member 121 and the heat transfer member may be chemically processed to increase the surface areas thereof, such that the heat transfer can be efficiently carried out.

The external reactor vessel cooling section 120 may be provided with a discharge pipe 122. The discharge pipe 122 may be connected to the external reactor vessel cooling section 120 and the power production section 130, respectively, such that the fluid of the external reactor vessel cooling section 120 can be supplied to the power production section 130 therethrough. The discharge pipe 122 may be branched to the pipe 124 to be connected to the power production section 130 through a valve 123.

The discharge pipe 122 may be provided with a first discharge portion 126 connected to a valve 125. The fluid which could be excessively supplied to the power production section 130 may be discharged through the first discharge portion 126. In detail, the first discharge portion 126 is a pipe through which a fluid (gas, steam) is discharged from the external reactor vessel cooling section 120 to the outside of the reactor building (not shown). Accordingly, a part of the fluid (gas, steam) can be discharged through the first discharge portion 126 when pressure of the system is increased or the fluid (liquid) is excessively supplied. The present invention has illustrated that the fluid is discharged to the outside of the reactor building (not shown) through the first discharge portion 126. However, the fluid to be discharged may alternatively be bypassed the power production section 130 and supplied and condensed in a condensation heat exchange section 140 to be reused according to characteristics of the nuclear power plants.

Further, the external reactor vessel cooling section 120 may be connected to the IRWST 180 such that refueling water is supplied through the pipe 183. In detail, the IRWST 180 may be connected to a valve 181 and a check valve 182. In addition, the external reactor vessel cooling section 120 may be provided with a second discharge portion 127 connected to a valve 127'. The second discharge portion 127 may be formed to discharge the refueling water supplied from the IRWST 180 therethrough. In detail, the second discharge portion 127 is a pipe through which a fluid (gas/steam or liquid/high temperature water) is discharged from the external reactor vessel cooling section 120 to the reactor building (not shown). Accordingly, the second discharge portion 127 can allow the reactor vessel to be cooled even when the external reactor vessel cooling section 120 and the power production section 130 are unable to perform cooling and electric power generation due to their failure or the like, which is caused by multiple failures of safety system, and may worsen to a severe accident and the like.

Meanwhile, the power production section 130 may be configured such that the fluid moving from the external reactor vessel cooling section 120 is injected therein. As the moved fluid actuates the small turbine 131, fluid energy of the fluid may be converted into mechanical energy (rotational force), and the mechanical energy may be converted into electric energy through the small generator 132 connected to the small turbine 131 with a shaft, thereby producing electric power. The small turbine 131 may generate electric power by receiving heat of a preset scale from the reactor vessel 110 in consideration of characteristics during a normal operation and during an accident.

In this embodiment, the present invention may have a configuration that power is produced in a variable manner in consideration of a rate of change in a steam flow rate which is caused due to a variation of a heat generated in the core 114 supplied during an accident, and may adjust a load of the power production section 130. Also, the small turbine 131 of the power production section 130 may be a small-capacity turbine, which may make it easy to apply seismic design or safety class to be described below.

The electric power that can be generated by the power production section 130 has a capacity of several tens of kWe to several MWe, which is less than 1% compared to the large-capacity feedwater system 10 and the large turbine 15 for producing normal power of the nuclear power plant, and even when the facility operates or fails during a normal operation of the nuclear power plant, there is little influence on the operation of the large capacity feedwater system 10 and the large turbine 15 for producing the normal nuclear power.

That is, the large-capacity feedwater system 10 and the large turbine 15 for producing the normal power are one of the biggest large-scale facilities of the nuclear power plant, and applying the seismic design and safety class above the whole facilities is very uneconomical because it causes a huge cost increase. Meanwhile, in case of the external reactor vessel cooling and electric power generation system 100 in which the small turbine 131 and the small generator 132 are provided, the size of the system 100 is much smaller than that of the feedwater system 10 and the large turbine 15. Thus, it is easy to apply seismic design or safety class thereto, and the increased cost due to applying the seismic design or the safety class is not so great. The small turbine 131 and the small generator 132 can be continuously operated to supply emergency electric power even when it is difficult to supply electric power due to an occurrence of an earthquake in conventional plants since seismic design is applied to the external reactor vessel cooling and electric power generation system 100. Also, the small turbine 131 and the small generator 132 can be continuously operated to supply emergency power even when various accidents occur since safety class is applied to the external reactor vessel cooling and electric power generation system 100 to secure system reliability.

Considering that electric power required in case of a passive nuclear power plant during an accident is several tens kWe although the emergency power has a difference according to characteristics of nuclear power plants, sufficient power can be supplied with only electric power produced by the small turbine 131 and the small generator 132. Besides, since the emergency DC battery capacity of the passive nuclear power plant is not greater than the emergency power required in an active nuclear power plant, the DC battery may be recharged by electric power produced by the small turbine 131 and the small generator 132.

The external reactor vessel cooling and electric power generation system 100 may be configured to have seismic design of seismic category I, II or seismic category III which are specified by ASME (American Society of Mechanical Engineers). In detail, seismic category I is applied to structures, systems and components which are classified as safety items, and should be designed to maintain an inherent 'safety function' in case of a safe shutdown earthquake (SSE). Also, seismic category I is designed such that the safety function is maintained even under an operating basis earthquake (OBE) in synchronization with a normal operation load, and appropriate allowable stresses and changes are within limits.

Though not requiring nuclear safety or continuous functions, seismic category II is applied to items whose structural damages or interaction may lower the safety functions of the structures, systems and components of the seismic category I or cause damage to an operator located within a main control room. In detail, the structures, systems and components belonging to the seismic category II are not required to have functional integrity for the SSE, but required only to have structural integrity. In addition, the structures, systems and components of the seismic category II should be designed and arranged so as not to impair safety-related operations of the items belonging to the seismic category I.

Seismic category III is designed according to uniform building codes (UBCs) or general industrial standards depending on individual design functions.

The external reactor vessel cooling and electric power generation system 100 may be configured to have a safety class of safety classes 1, 2 or 3 of the nuclear power plant specified by the American Society of Mechanical Engineers (ASME). In detail, the safety class of the nuclear power plant is typically divided into safety classes 1 to 3.

Safety class 1 is a grade assigned to a RCS(reactor coolant system) pressure-boundary portion of a facility and its support that constitute a reactor coolant pressure boundary (a portion that may cause a loss of coolant beyond a normal make-up capacity of the reactor coolant in the event of a failure).

Safety class 2 may be assigned to a pressure-boundary portion of the reactor containment building and its support, and assigned to a facility and its support that perform the following safety functions while not belonging to safety class 1.

- A function of preventing the release of fission products or containing or isolating radioactive materials in the containment building
- A function of removing heat or radioactive materials generated in the containment building in case of an emergency (e.g., containment building spray system), a function of increasing negative reactivity to make the reactor in a subcritical state in case of an emergency or suppressing an increase of positive reactivity (e.g., boric acid injection system)
- A function of supplying coolant directly to the core during an emergency to ensure core cooling (e.g., residual heat removal, emergency core cooling system) and a function of supplying or maintaining sufficient reactor coolant for cooling the reactor core during an emergency (e.g., refueling water storage tank) Safety class 3 is not included in safety classes 1 and 2, and may be assigned to a facility that performs one of the following safety functions:
- A function of controlling concentration of hydrogen in the reactor containment building within an allowable limit
- A function of removing radioactive materials from a space (e.g., main control room, nuclear fuel building) outside the reactor containment building with safety class 1, 2 or 3 facilities
- A function of increasing negative reactivity to make or maintain the reactor in a subcritical state (e.g., boric acid make-up)
- A function of supplying or maintaining sufficient reactor coolant for core cooling (e.g., Reactor coolant replenishment system)
- A function of maintaining a geometric structure inside the reactor to ensure core reactivity control or core cooling capability (e.g., core support structure)
- A function of supporting or protecting the load for safety class 1, 2 or 3 facilities (concrete steel structures not included in KEPIC-MN, ASME sec. III).
- A function of shielding for radiation for people outside the reactor control room or nuclear power plant
- A cooling function of spent fuel (e.g., spent fuel pool and cooling system)
- A function of ensuring safety functions performed by safety class 1, 2 or 3 facilities (e.g., a function of removing heat from safety class 1, 2 or 3 heat exchangers, a safety class 2 or 3 pump lubrication function, a fuel supplying function of emergency diesel generator)
- A function of supplying electric power or motive power to safety class 1, 2 or 3 facilities
- A function of providing informations or controlling informations for safety class 1, 2 or 3 facilities to perform the safety functions automatically or manually
- A function of supplying or receiving signals for safety class 1, 2 or 3 facilities to perform the safety functions
- Manual or automatic interlocking function for safety class 1, 2 or 3 facilities to perform the safety functions
- A function of providing appropriate environmental conditions for safety class 1, 2 or 3 facilities and an operator
- A function corresponding to safety class 2 to which standards for the design and manufacture of pressure vessels, KEPIC-MN, ASME Sec. III, are not applied The condensation heat exchange section 140 is configured to perform heat exchange with the fluid discharged from the power production section 130 including the small turbine 131 and the small generator 132 subsequent to producing electric energy, and shrink the fluid to generate condensed water. In detail, the condensation heat exchange section 140 includes a heat exchanger to condense the fluid so as to recover the fluid in the form of condensed water. The heat exchanger of the condensation heat exchange section 140 may be a shell-and-tube type heat exchanger or a plate type heat exchanger. However, the heat exchanger disclosed herein is not limited to this and may be any heat exchanger capable of condensing the fluid to generate condensed water.

The condensing heat exchange section 140 is provided with a motor 141 or a pump (not shown), and the motor 141 or the pump may supply a cooling fluid to the condensation heat exchange section 140 so as to exchange heat with the fluid. The cooling fluid may be air, pure water, seawater or a mixture thereof. The motor 141 may provide rotational power to a fan 142 or to a pump. The fan 142 may be a cooling fan when an air-cooling type heat exchanger is applied, and the condensation heat exchange section 140 may be downsized using the cooling fan.

In addition, a discharge fan (not shown) may selectively be provided in an vent portion 143. Accordingly, when non-condensable gas is accumulated in the condensation heat exchange section 140, the discharge fan may remove the non-condensable gas, thereby improving the heat exchange of the condensation heat exchange section 140 and lowering pressure thereof. In addition, there may be various methods of discharging gas, such as using pressure drop of the Venturi by a steam flow rate, and thus the present invention is not limited to a specific form.

The motor 141 may be supplied with electric power produced by the power production section 130 itself through a connecting line 133. The fan 142 connected to the motor 141 may supply cooling air to the condensation heat exchange section 140 to efficiently perform the heat exchange in the condensation heat exchange section 140. In addition, the motor 141 may be provided to charge electric power produced by the power production section 130 to an emergency battery 173 and receive electric power from the emergency battery 173.

A pipe 144 may be provided between the condensation heat exchange section 140 and the condensed water storage section 150 such that the fluid flows therealong. The condensed water generated in the condensation heat exchange section 140 is transferred to the condensed water storage section 150 along the pipe 144. In detail, the condensed water storage section 150 may be disposed below the condensation heat exchange section 140 to collect the condensed water generated in the condensation heat exchange section 140.

In the embodiment of the present invention, the condensed water in the condensation heat exchange section 140 is transferred to the condensed water storage section 150 by gravity. However, depending on characteristics of nuclear power plants, a pump may be installed in the connected pipe between the condensation heat exchange section 140 and the condensed water storage section 150 so that the condensed water is forcibly transferred.

In addition, a pipe 144' for transferring steam or non-condensable gas, which may be accumulated in the condensation heat exchange section 140, to the condensed water storage section 150 may be additionally provided.

The condensed water collected in the condensed water storage section 150 may circulate through the external reactor vessel cooling section 120, the power production section 130, and the condensation heat exchange section 140.

Further, the condensed water storage section 150 may be connected to the external reactor vessel cooling section 120 through a pipe 160 such that the condensed water is supplied to the external reactor vessel cooling section 120.

Specifically, the condensed water of the condensed water storage section 150 may be supplied into a pipe 160 connected to the external reactor vessel cooling section 120 by gravity through a valve 154 and a check valve 155 connected to the pipe 153. The condensed water of the condensed water storage section 150 may be passed through a valve 161 and a check valve 162 by a motor 157 and a small feedwater pump 158 connected to a pipe 156 to be supplied into the pipe 160 connected to the external reactor vessel cooling section 120.

Similar to the condensation heat exchange section 140 described above, the condensed water storage section 150 may include a motor 151 and a fan 152, and the motor 151 is capable of providing rotation power to the fan 152. The fan 152 may discharge non-condensable gas to lower pressure of the condensed water storage section 150 when the non-condensable gas is accumulated in the condensed water storage section 150. However, various methods of discharging gas including the method of using the pressure drop of the Venturi by the steam flow rate may be applied. Therefore, the method of discharging the non-condensing gas is not limited to a specific form. In the present invention, the motor 151 and the fan 152 are provided above the condensed water storage section 150, but the motor 151 and the fan 152 may alternatively be provided in the condensation heat exchange section 140.

The motor 151 described above may receive power produced by the small turbine 131 itself through the connecting line 134. In addition, the motor 151 may be provided to charge electric power produced by the power production section 130 to the emergency battery 173 and receive electric power from the emergency battery 173.

The power system 170 may be configured to use the power produced during the normal operation of the nuclear power plant as power of the internal/external electric power system 171. In detail, the internal/external electric power system 171 may be a system for processing electricity supplied from an on-site large turbine generator, the power production section 130, an on-site diesel generator, and an external power grid.

In addition, electric energy may be stored in the emergency battery 173 through the charger 172, which is a facility for storing alternating current (AC) electricity supplied from the on-site, the outside, or the power production section 130 or the like. The emergency battery 173 may be a battery provided in an on-site to supply emergency DC power used during an accident.

Further, the electric energy stored in the emergency battery 173 may be supplied to the emergency power consuming device 174 and used as emergency power. The emergency power may be used as power for operating the nuclear power plant safety system, opening or closing a valve for the operation of the nuclear power plant safety system, or monitoring the nuclear safety system during an accident of the nuclear power plant. Moreover, the electric power produced by the power production section 130 during an accident of the nuclear power plant may also be supplied as the emergency power of the nuclear power plant.

Moreover, when the heat exchange section 120 and the power production section 130 fail due to multiple failures, a flow path through the IRWST 180 and the first discharge portion 127 is already formed, and therefore, smooth supply and discharge of cooling water may be enabled by a simple operation such as opening/closing valves according to an operator action, such that the cooling water can be supplied effectively for cooling the reactor vessel 110.

Figure 1B:
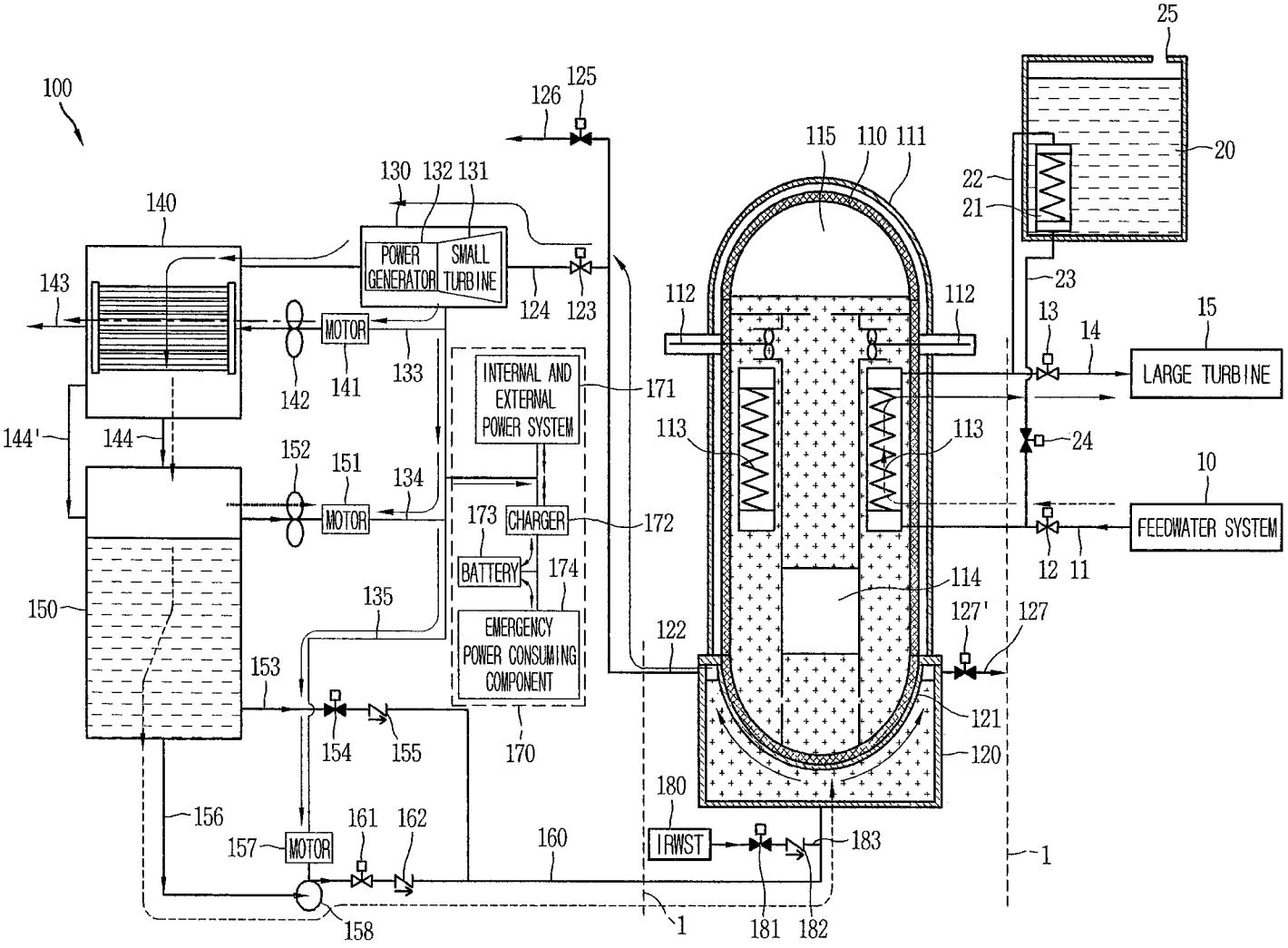
FIG. 1B is a conceptual view illustrating a normal operation of an external reactor vessel cooling and electric power generation system according to the embodiment of the present invention.

FIG. 1B is a conceptual view illustrating a normal operation of the external reactor vessel cooling and electric power generation system 100 according to the embodiment of the present invention.

Referring to FIG. 1B, it is a conceptual view illustrating system arrangement and a flow of fluid during a normal operation of a nuclear power plant. During the normal operation of the nuclear power plant, main feedwater (water) is supplied from the feedwater system 10 to the steam generator 113, and heat received from the core 114 by the reactor coolant circulation is transferred to a secondary system through the steam generator 113 so as to increase a temperature of the main feedwater and produce steam. The steam of the main feedwater produced from the steam generator 113 is supplied to the large turbine 15 along the main steam line 14 to rotate the large turbine 150 and rotate the large generator (not shown) connected through a shaft so as to produce electric power. The electric power produced through the large generator may be supplied to an on-site or off-site electric power system.

On the other hand, feedwater supplied from the small feedwater pump 158 to the external reactor vessel cooling section 120 through the pipe 160 receives heat while rising along the external wall of the reactor vessel 110, thereby generating steam. The steam is supplied to the power production section 130 including the small turbine 131 and the small generator 132 along the discharge pipe 122 disposed at an upper part of the external reactor vessel cooling section 120. Fluid energy of the steam is converted into mechanical energy while rotating the small turbine 131, and the mechanical energy is converted into electric energy by the small generator 132 connected to the small turbine 131 by the shaft, thereby producing electric power. Further, the electric power produced by the power production section 130 may be supplied as electric power of the internal/external electric power system 171 through the electric power system 170. In addition, electric energy may be stored in the emergency battery 173 through the charger 172, which is a facility for storing alternating current (AC) electricity supplied from the on-site, the outside, or the power production section 130 or the like. The emergency battery 173 may be a battery provided in the on-site to supply emergency DC power used during an accident. Further, the electric power may be supplied to the emergency power consuming device 174 and used as emergency power.

Figure 1C:
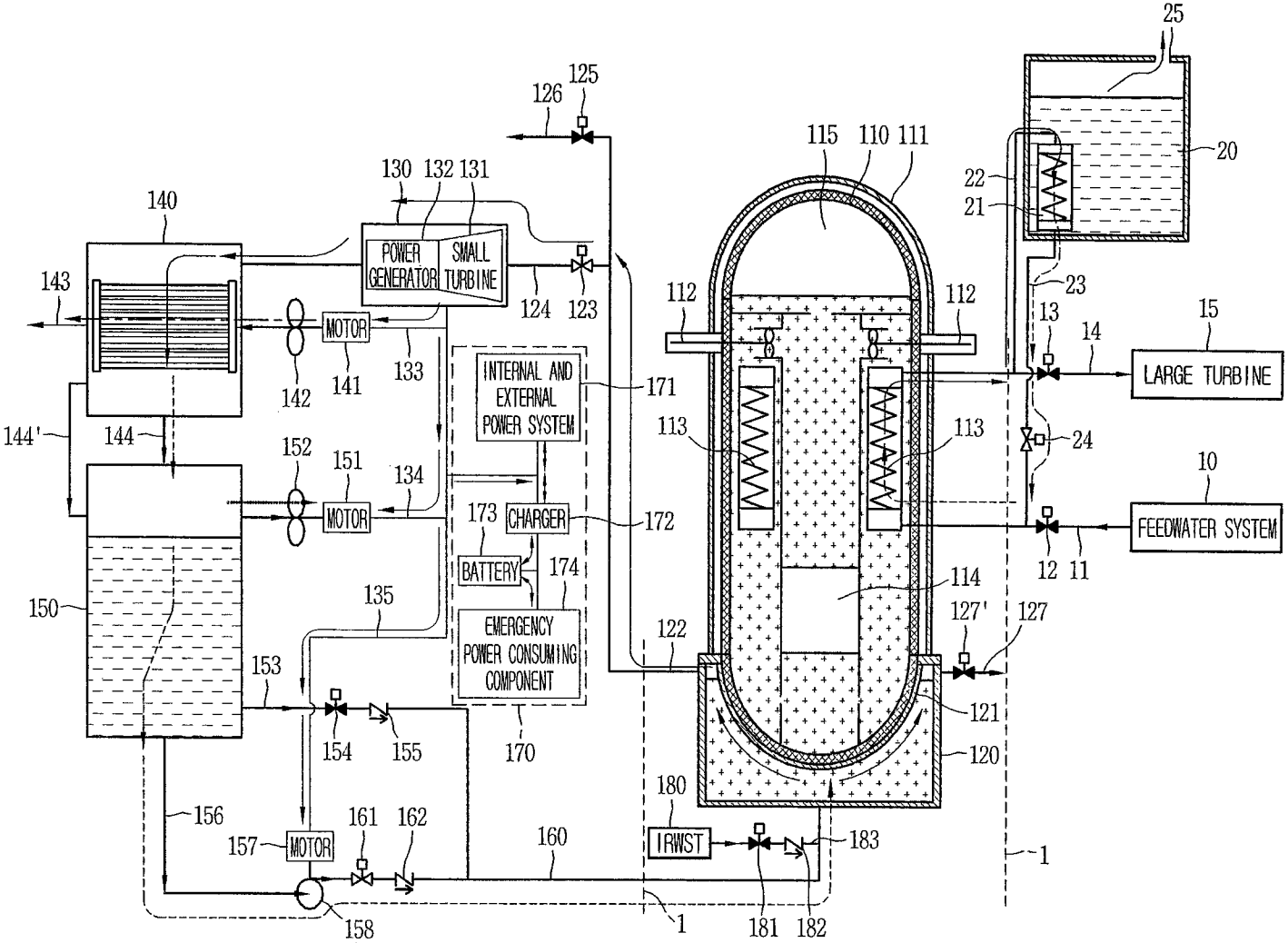
FIG. 1C is a conceptual view illustrating a design basis accident operation of an external reactor vessel cooling and electric power generation system according to the embodiment of the present invention.

FIG. 1C is a conceptual view illustrating a design basis accident (DBA) operation of an external reactor vessel cooling and electric power generation system according to an embodiment of the present invention.

Referring to FIG. 1C, it is a conceptual view illustrating the operation of the external reactor vessel cooling and electric power generation system 100 including the small feedwater pump 158, the power production section 130 and the like, during a design basis accident (DBA) of a nuclear power plant.

Specifically, when an accident occurs in a nuclear power plant due to various causes, safety systems, such as a passive residual heat removal system, a passive safety injection system and a passive containment cooling system, including the emergency cooling water storage section 20, which are installed in a plurality of trains, may be automatically operated in response to related signals. Further, steam generated by the operation of the safety system may be discharged from a steam discharge portion 25 of the emergency cooling water storage section 20.

The operation of the safety system may remove residual heat generated in the reactor coolant system 111 and the core 114. In addition, safety injection water may be supplied to the reactor coolant system 111 to lower pressure and temperature of the reactor coolant system 111 and lower the temperature of the core 114. Also, a pressure increase inside the reactor containment (not shown) may be suppressed by the operation of the passive containment cooling system, so as to protect the reactor containment.

On the other hand, while the isolation valves 12, 13 provided in the main feedwater line 11 and the main steam line 14 are closed, the operation of the large turbine 15 is stopped. However, even when the reactor core 114 is stopped, residual heat is generated in the core 114 for a considerable period of time, and a lot of sensible heat is present in the reactor coolant system 110 and the reactor vessel 110. As a result, the temperature of the reactor coolant system 111 does not decrease rapidly.

Accordingly, even when an accident occurs, the external reactor vessel cooling section 120 and the power production section 130 may be operated in the same state as a normal operation. Therefore, the power production section 130 may cool the reactor vessel 110 while continuously producing electric power. As time elapses, the residual heat generated in the core 114 may decrease and the temperature of the reactor vessel 110 may decrease while the reactor vessel 110 is cooled by the safety system. In this case, the external reactor vessel cooling and electric power generation system 100 may be operated in substantially the same manner as the normal operation while reducing the amount of electric power generated by the power production section 130 due to the reduction in an amount of heat transferred.

Figure 1D:
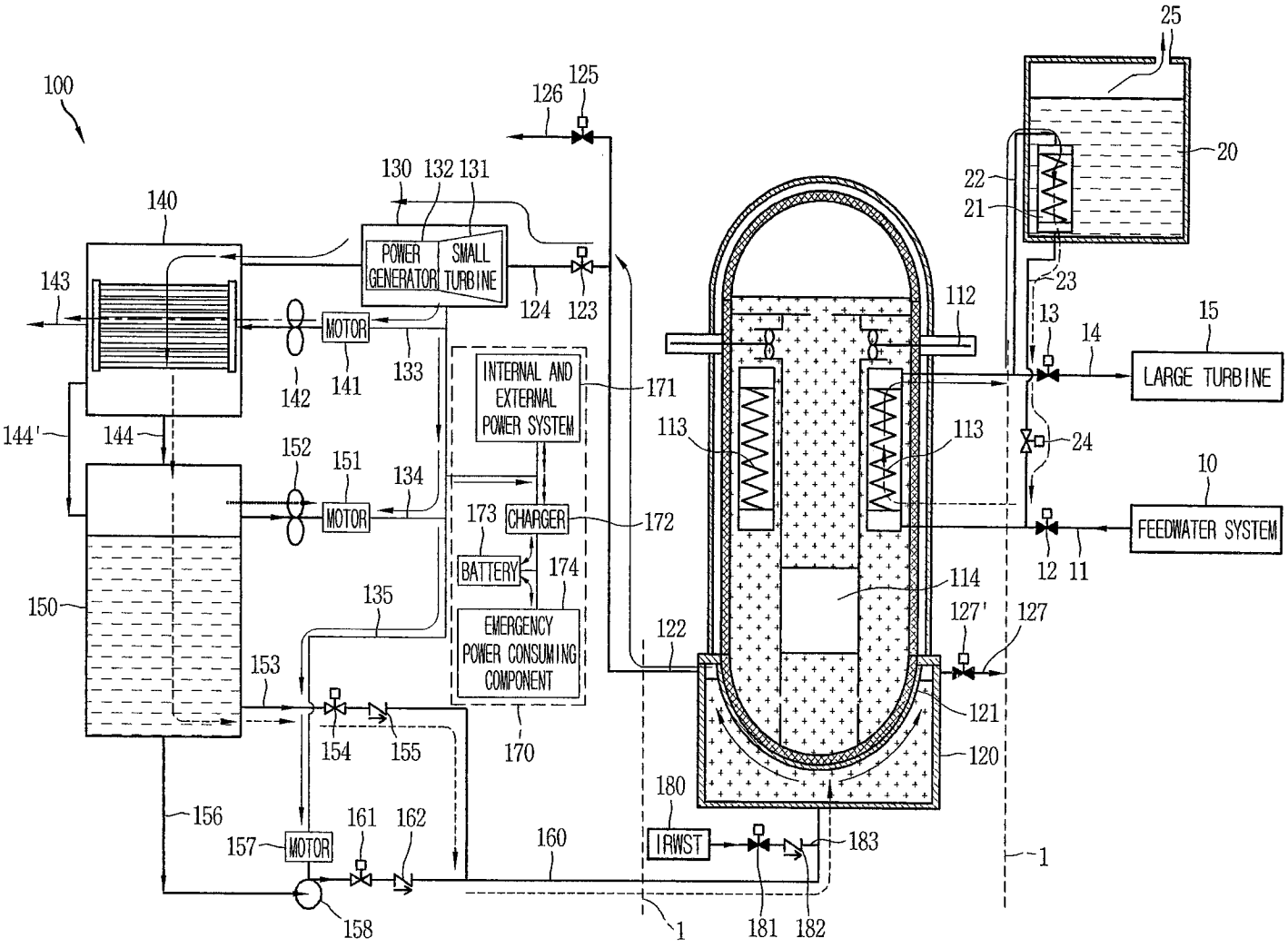
FIG. 1D is a conceptual view illustrating a design basis accident operation of an external reactor vessel cooling and electric power generation system according to the embodiment of the present invention.

FIG. 1D is a conceptual view illustrating a design basis accident (DBA) operation of an external reactor vessel cooling and electric power generation system 100 according to an embodiment of the present invention.

Referring to FIG. 1D, it is a conceptual view of a case where the operation of the small feedwater pump 158 is disabled following the design basis accident and operation of the external reactor vessel cooling and electric power generation system 100 through the path 153 is activated. As illustrated in the foregoing case of FIG. 1C, the safety systems, such as the passive residual heat removal system, the passive safety injection system, and the passive containment cooling system, including the emergency cooling water storage section 20, which are installed in the plurality of trains, may be automatically operated in response to relative signals. Accordingly, the reactor coolant system may be cooled, the residual heat of the core 114 may be removed and safety injection water may be supplied to the reactor coolant system so as to lower pressure and temperature of the reactor coolant system and lower the temperature of the core 114. Also, a pressure increase inside the reactor containment (not shown) may be suppressed so as to protect the reactor containment. On the other hand, while the isolation valves 12, 13 provided in the main feedwater line 11 and the main steam line 14 are closed, the operation of the large turbine 15 is stopped.

In detail, when feedwater supplied from the small feedwater pump is interrupted for various reasons, the pipe 153 connected to the condensed water storage section 150 may be opened in response to a related signal or by an operator action to supply feedwater from the condensed water storage section 150. At this time, the feedwater may be supplied by natural circulation by gravity. The gravity may be applied to the condensed water in the condensed water storage section 150 so that the condensed water can be supplied in the natural circulation manner. Accordingly, the operation state of the external reactor vessel cooling section 120 and the power production section 130 may be similar to that during a normal operation except for the feedwater pump 158. As time elapses, when a steam generation amount is reduced due to a gradual reduction of the residual heat of the core 114, the operation state may become similar to that during the normal operation while adjusting the power production amount of the power production section 130.

Figure 1E:
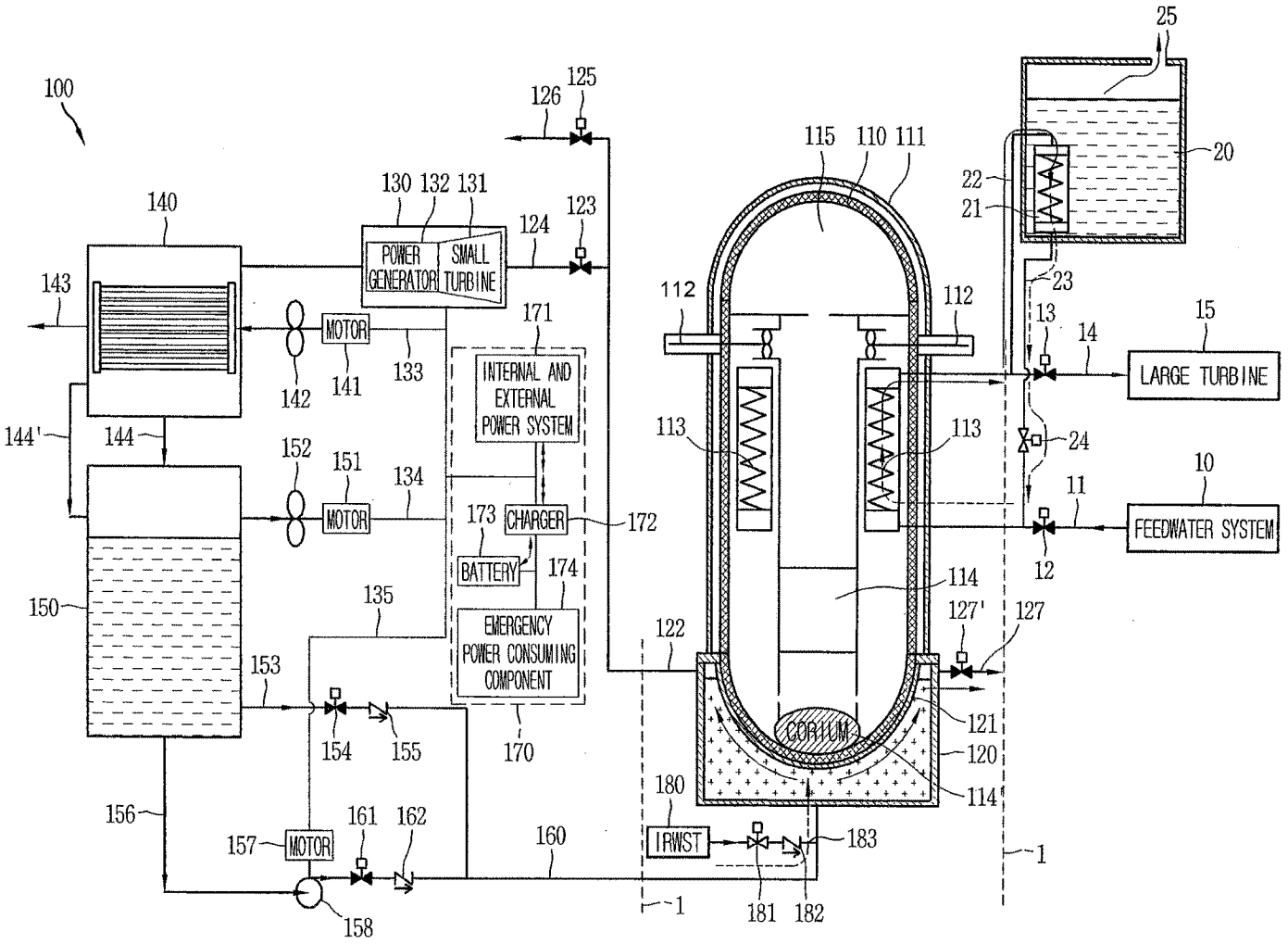
FIG. 1E is a conceptual view illustrating a severe accident operation of an external reactor vessel cooling and electric power generation system according to the embodiment of the present invention.

FIG. 1E is a conceptual view illustrating a severe accident operation of an external reactor vessel cooling and electric power generation system 100 in accordance with an embodiment of the present invention.

Referring to FIG. 1E, it is a conceptual view in which the operation of the external reactor vessel cooling and electric power generation system 100 is disabled due to multiple failures including the failures of the system 100, and severe accidents(core melting) occur. As illustrated in the foregoing case of FIG. 1C, the safety systems, such as a passive residual heat removal system, the passive safety injection system, and the passive containment cooling system, including the emergency cooling water storage section 20, which are installed in the plurality of trains, may be automatically operated in response to relative signals. However, when it is assumed that various safety systems do not operate although it is rarely likely to occur, an accident in which the core is melted down due to a temperature rise of the core may occur.

For example, in order to block the discharge of radioactive materials to the outside of the reactor containment during a severe accident such as a generation of corium of nuclear accidents, the operation of the external reactor vessel cooling section 120 and the power production section 130 may be stopped. Accordingly, the pipe 183 connected to the IRWST 180 may be opened in response to a related signal or by an operator action to supply feedwater from the IRWST 180 so as to cool the lower part of the reactor vessel 110, and the valve 127' installed on the second discharge portion 127 may be opened to discharge generated steam. Depending on characteristics of nuclear power plants, the feedwater may be forcibly injected by installing a pump (not shown) in the pipe 183 connected to the IRWST 180 or may be injected using gravity.

Furthermore, even when a severe accident such as damage to the reactor vessel or exposure of the reactor core 114 occurs of nuclear accidents, in addition to the generation of the corium 114' in the reactor, the operation of the external reactor vessel cooling section 120 and the power production section 130 may be stopped to allow the injection of feedwater through the IRWST 180 and the opening of the valve 127' connected to the first discharge portion 127 in terms of protection.

Furthermore, according to another embodiment described below, the same or similar reference numerals are designated to the same or similar configurations to the foregoing example, and the description thereof will be substituted by the earlier description.

Figure 2A:
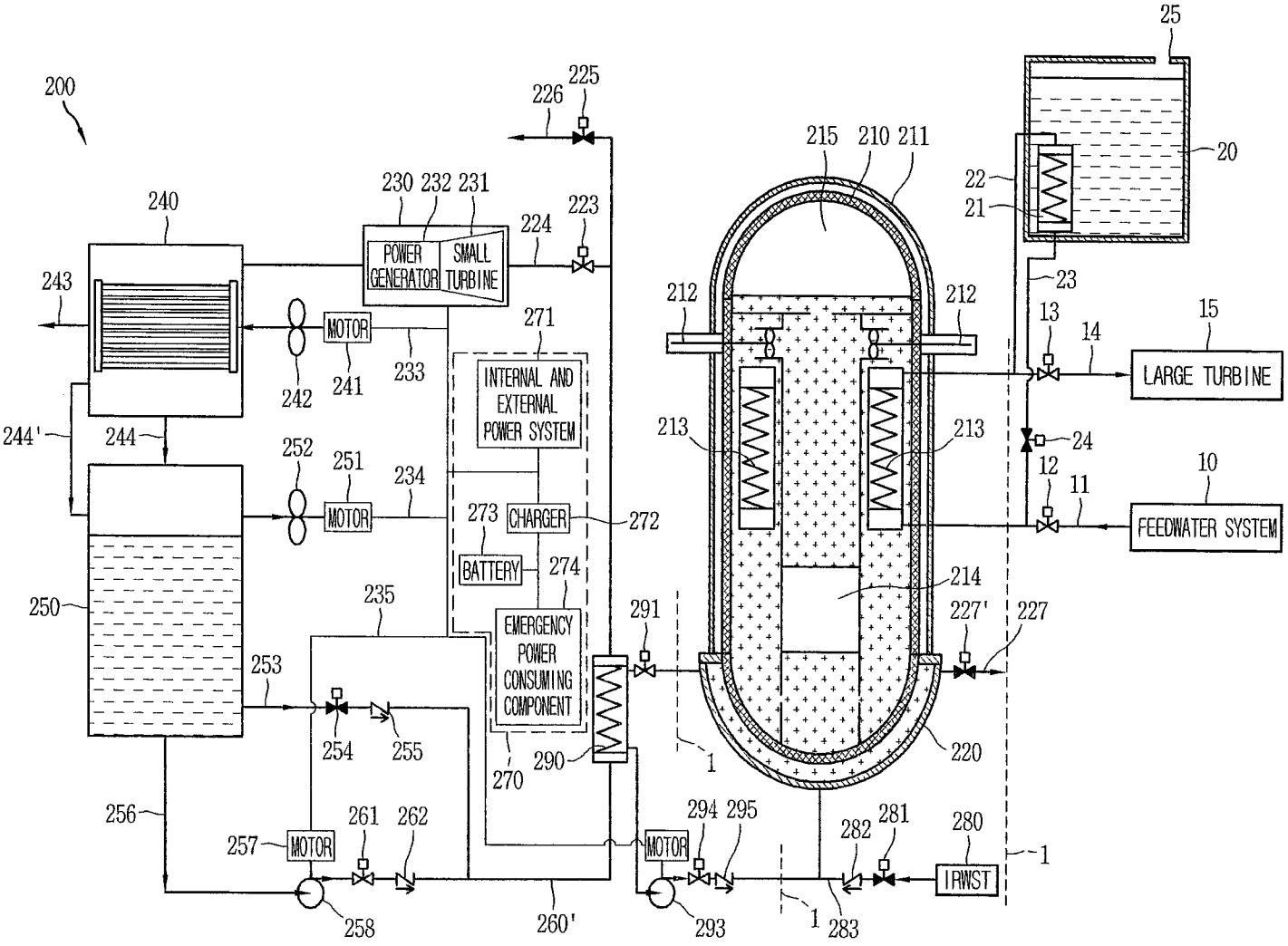
FIG. 2A is a conceptual view of an external reactor vessel cooling and electric power generation system in accordance with another embodiment of the present invention.

FIG. 2A is a conceptual view of an external reactor vessel cooling and electric power generation system in accordance with another embodiment of the present invention.

An evaporation section 290 connected to an external reactor vessel cooling section 220 may further be provided. The evaporation section 290 may be configured to perform heat exchange between a fluid inside the external reactor vessel cooling section 220 and condensed water of a condensed water storage section 250.

In detail, a first circulation part may be formed from the external reactor vessel cooling section 220 to the evaporation section 290 such that a fluid flow therealong. On the other hand, a second circulation part may be formed sequentially along the evaporation section 290, a power production section 230, a condensation heat exchange section 240, and the condensed water storage section 250 such that the fluid flows therealong. That is, the first circulation part and the second circulation part may have a dual circulation loop. The evaporation section 290 may be formed to be a boundary between the first circulation part and the second circulation part. The first circulation part may be configured such that a single-phase fluid flows therealong. In detail, the single-phase fluid of the first circulation part may be compressed gas. In addition, a compressor 293 and a blower (not shown) may be provided to allow the circulation of the single-phase fluid of the first circulation part, and activate the external reactor vessel cooling section 220 to transfer heat to the evaporation section 290.

Further, the external reactor vessel cooling section 220 may be formed in a hemispherical shape and may also cool an external wall of a reactor vessel 210 without a coating member or a heat transfer enhancement member.

Figure 2B:
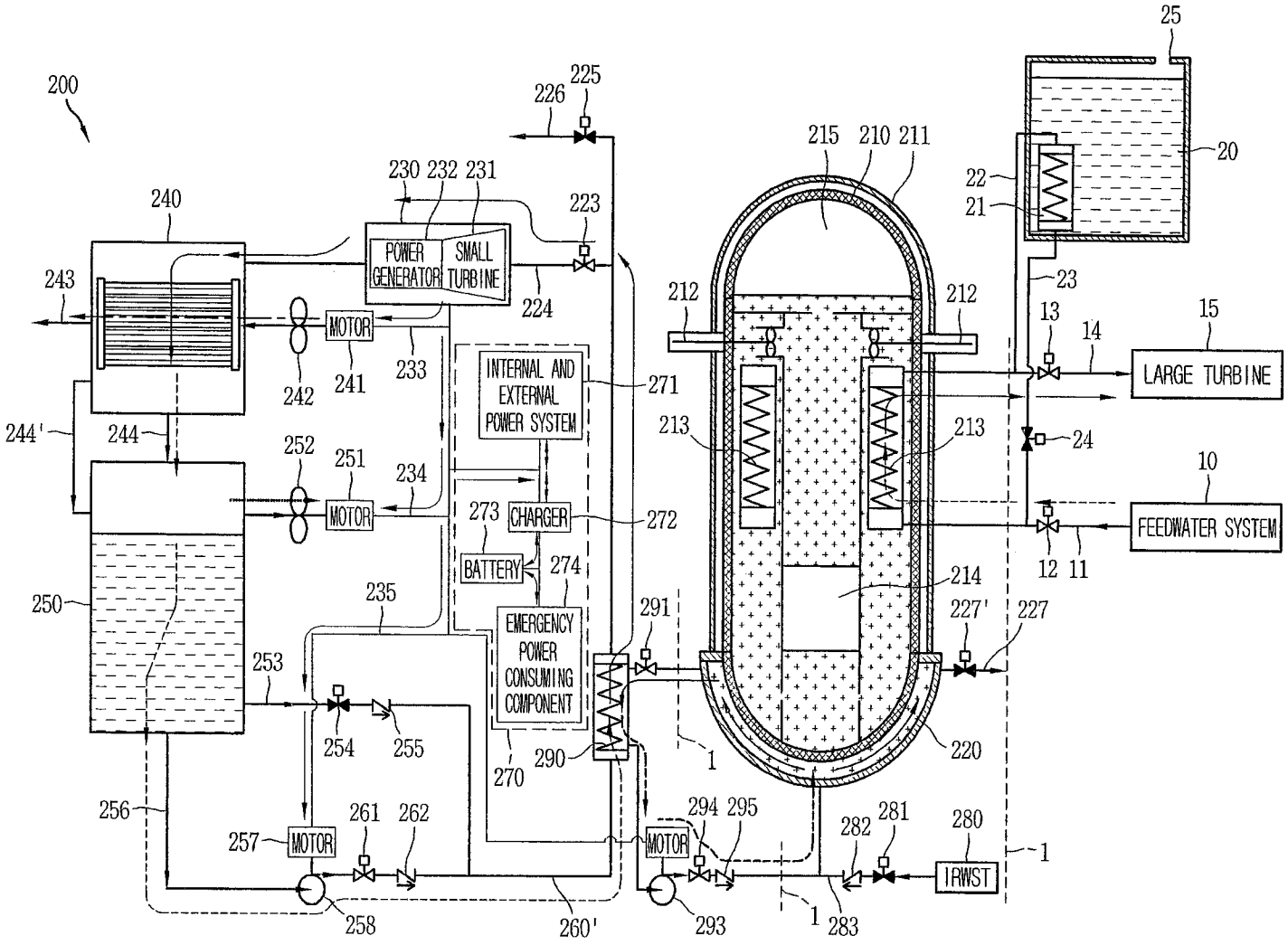
FIG. 2B is a conceptual view illustrating a normal operation of an external reactor vessel cooling and electric power generation system according to another embodiment of the present invention.

FIG. 2B is a conceptual view illustrating a normal operation of the external reactor vessel cooling and electric power generation system according to the another embodiment of the present invention.

Referring to FIG. 2B, it is a conceptual view illustrating system arrangement and a flow of fluid during a normal operation of a nuclear power plant. During a normal operation of a nuclear power plant, main feedwater (water) is supplied from the feedwater system 10 to a steam generator 213, and heat received from a core 214 by a reactor coolant circulation is transferred to a secondary system through the steam generator 213 to increase a temperature of the main feedwater and produce steam. The steam produced from the steam generator 213 is supplied to the large turbine 15 along the main steam line 14 to rotate the large turbine 150 and rotate the large generator (not shown) connected through the shaft so as to produce electric power. The electric power produced through the large generator may be supplied to an on-site or off-site from the power system.

The single-phase fluid inside the external reactor vessel cooling section 220 provided along the external wall of the reactor vessel 210 is moved to the evaporation section 290 by receiving heat from the external wall of the reactor vessel 210. The single-phase fluid moved to the evaporation section 290 may exchange heat with a fluid, which is to be supplied to the power production section 230 including a small turbine 231 and a small generator 232, and circulate the first circulation part formed between the external reactor vessel cooling section 220 and the evaporation section 290. Further, a compressor 293 and a blower (not shown) connected to a motor 296 may be configured to allow the circulation of the single-phase fluid of the first circulation part.

On the other hand, feedwater supplied from a small feedwater pump 258 to the evaporation section 290 through a pipe 260' is supplied to the power production section 230 including a small turbine 231 and a small generator 232 while circulating the second circulation part. Fluid energy of the steam may be converted into mechanical energy while circulating the small turbine 231 and the mechanical energy may be converted into electric energy while rotating the small generator 232 connected through the shaft, thereby producing electric power. Further, the electric power produced by the power production section 230 may be utilized by the power system 270.

Figure 2C:
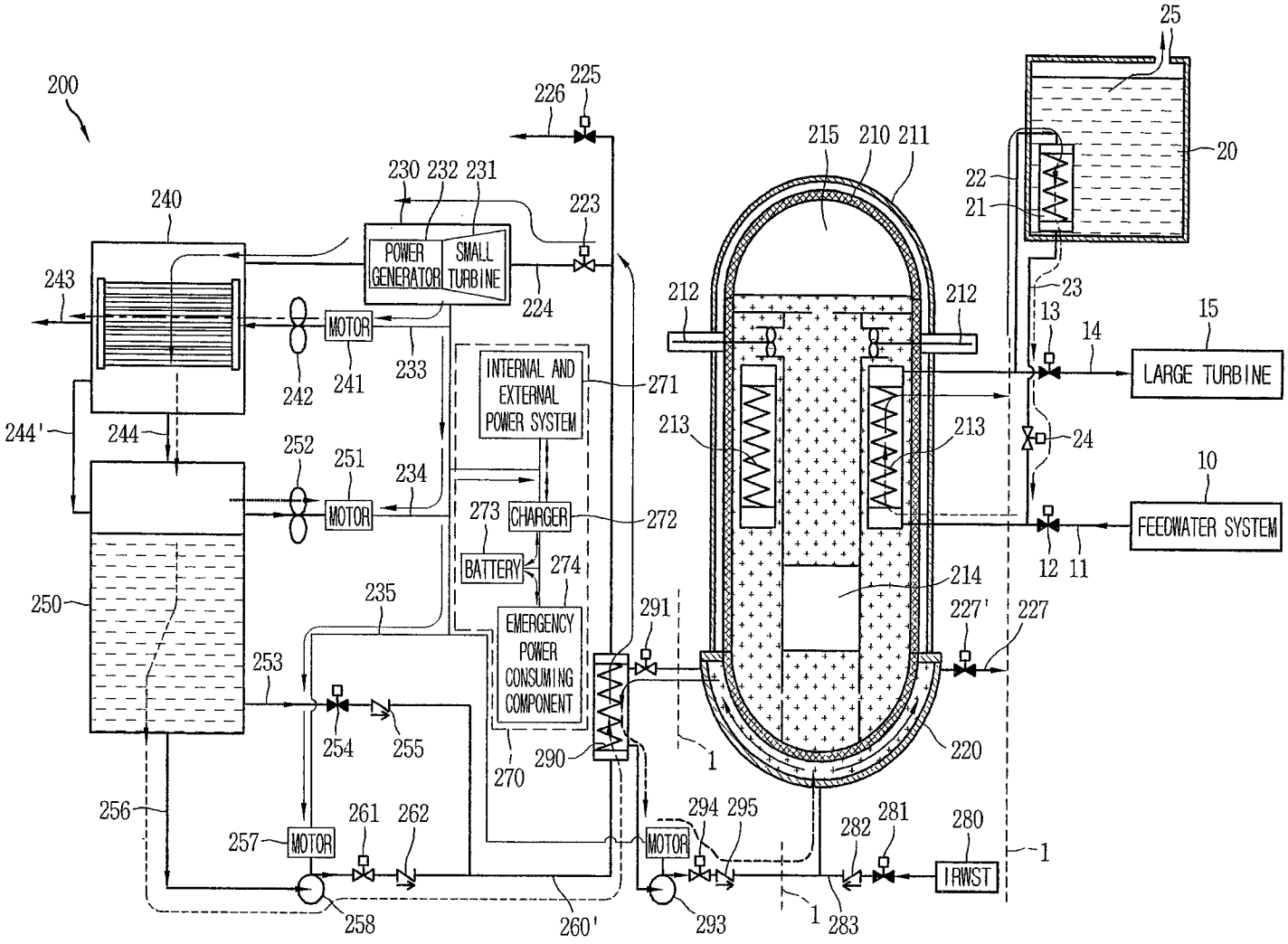
FIG. 2C is a conceptual view illustrating a design basis accident operation of the external reactor vessel cooling and electric power generation system according to another embodiment of the present invention.

FIG. 2C is a conceptual view illustrating a design basis accident operation of the external reactor vessel cooling and electric power generation system 200 according to the another embodiment of the present invention.

Referring to FIG. 2C, it is a conceptual view illustrating an operation of the external reactor vessel cooling and electric power generation system 200 in case where the small feedwater pump 258, the power production section 230, and the like can be operated during a design basis accident of a nuclear power plant.

Specifically, when an accident occurs in a nuclear power plant due to various causes, the safety systems, such as the passive residual heat removal system, the passive safety injection system, and the passive containment cooling system, including the emergency cooling water storage section 20, which are installed in the plurality of trains, may be automatically operated in response to related signals. Further, steam generated by the operation of the safety system may be discharged from the steam discharge portion 25 of the emergency cooling water storage section 20.

The operation of the safety system may remove residual heat generated in the reactor coolant system and the core 214. In addition, safety injection water may be supplied to the reactor coolant system to lower pressure and temperature of the reactor coolant system and lower temperature of the core 214. Also, a pressure increase in the reactor containment (not shown) may be suppressed by the operation of the passive containment cooling system so as to protect the reactor containment.

On the other hand, while the isolation valves 12, 13 provided in the main feedwater line 11 and the main steam line 14 are closed, the operation of the large turbine 15 is stopped. However, since the temperature of the reactor vessel 210 is similar in the early stage of the accident, the external reactor vessel cooling section 220 and the power production section 230 connected to the evaporation section 290, respectively, may be operated in the same state as a normal operation.

As time elapses, when the temperature of the reactor vessel 210 decreases in response residual heat generated in the core 214 being reduced and the reactor vessel 210 being cooled by the safety system, the power production section 230 may be operated similar to the normal operation while adjusting a power production amount according to an amount of heat transferred thereto.

Figure 2D:
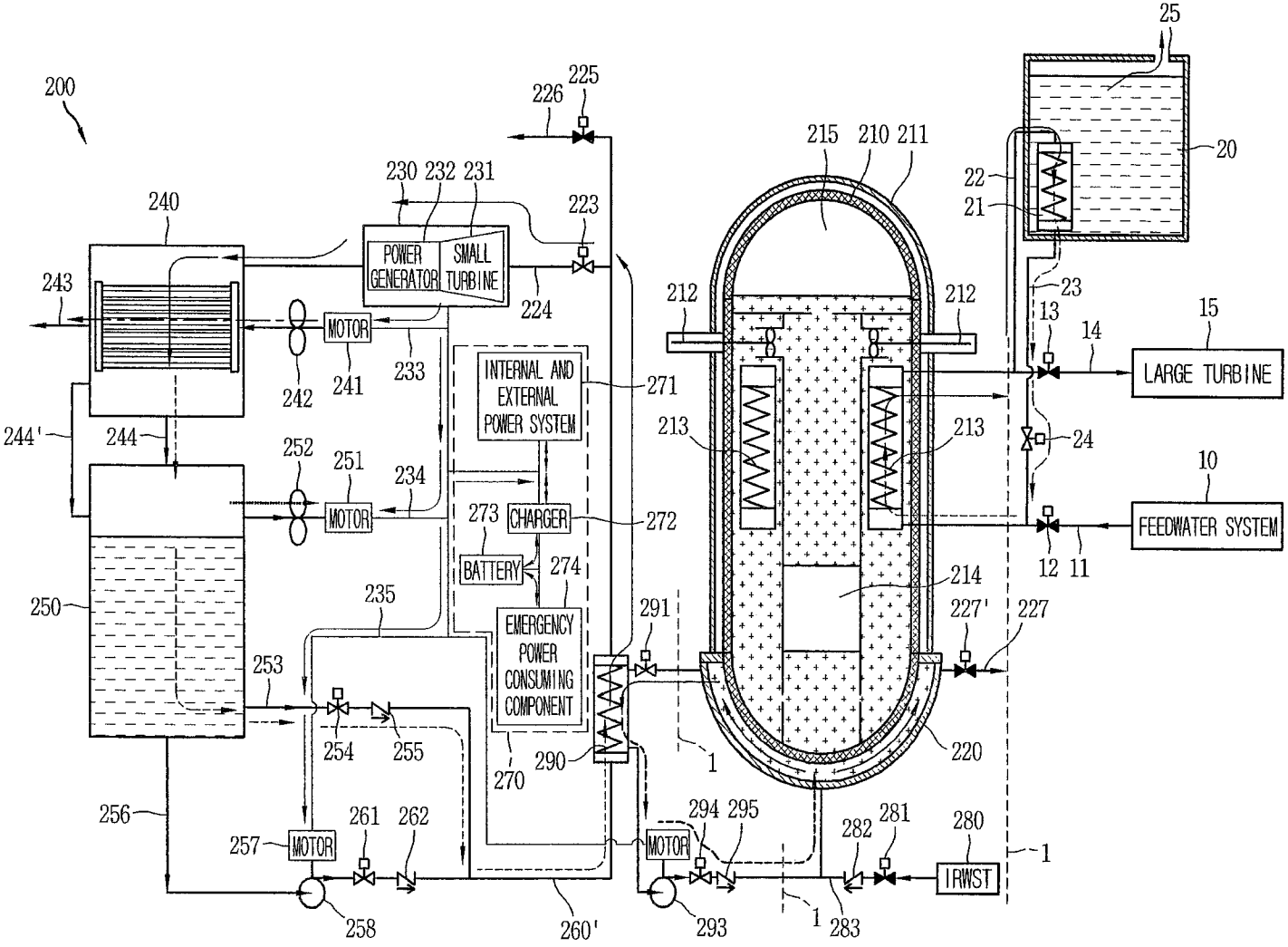
FIG. 2D is a conceptual view illustrating a design basis accident operation of the external reactor vessel cooling and electric power generation system according to another embodiment of the present invention.

FIG. 2D is a conceptual view illustrating a design basis accident (DBA) operation of the external reactor vessel cooling and electric power generation system 200 according to the another embodiment of the present invention.

Referring to FIG. 2D, it is a conceptual view illustrating the operation of the external reactor vessel cooling and electric power generation system 200 when the operation of the small feedwater pump 258 is disabled during a design basis accident of a nuclear power plant. As illustrated in the foregoing case of FIG. 2C, the safety systems, such as the passive residual heat removal system, the passive safety injection system, and the passive containment cooling system, including the emergency cooling water storage section 20, which are installed in the plurality of trains, may be automatically operated in response to relative signals. Accordingly, the reactor coolant system may be cooled, the residual heat of the core 214 may be removed and safety injection water may be supplied to the reactor coolant system so as to lower pressure and temperature of the reactor coolant system and lower the temperature of the core 214. Also, a pressure increase in the reactor containment (not shown) may be suppressed so as to protect the reactor containment. On the other hand, while the isolation valves 12, 13 provided in the main feedwater line 11 and the main steam line 14 are closed, the operation of the large turbine 15 is stopped.

In detail, when feedwater supplied from the small water supply pump is interrupted for various reasons, the pipe 253 connected to the condensed water storage section 250 may be opened in response to a related signal or by an operator action to supply water from the condensed water storage section 250. At this time, the feedwater may be supplied by natural circulation by gravity. The gravity may be applied to the condensed water in the condensed water storage section 250 so that the condensed water can be supplied in the natural circulation manner. Accordingly, the reactor vessel external wall cooling unit 220 and the power production section 230 can be operated in an operating state similar to that during normal operation. However, when the residual heat of the core 214 gradually decreases and the heat transferred to the evaporator 290 decreases, the power production section 230 may be operated in a similar manner to the normal operation while adjusting the power production amount.

Figure 2E:
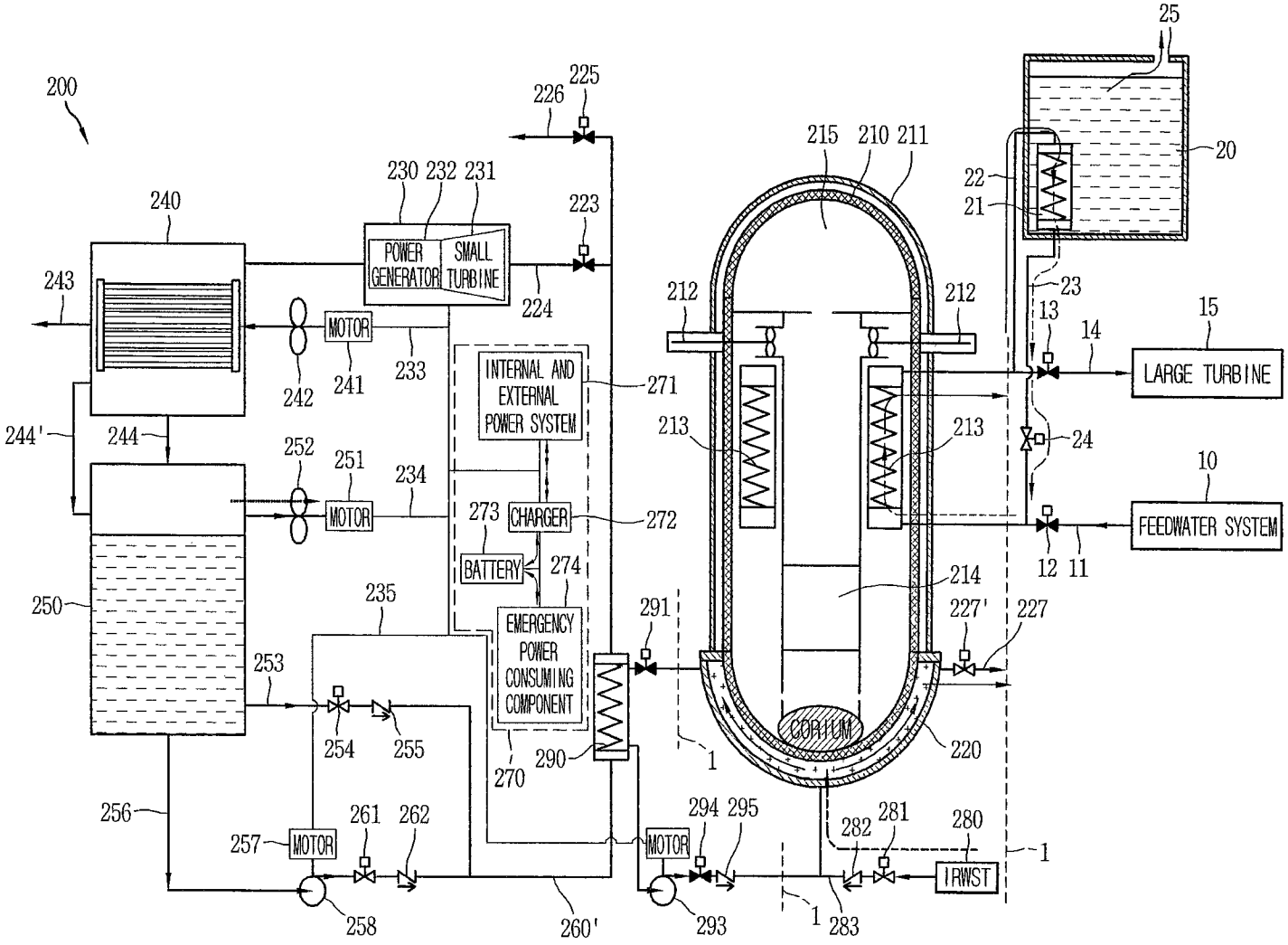
FIG. 2E is a conceptual view illustrating a severe accident operation of the external reactor vessel cooling and electric power generation system according to another embodiment of the present invention.

FIG. 2E is a conceptual view illustrating a severe accident operation of the external reactor vessel cooling and electric power generation system 200 in accordance with the another embodiment of the present invention.

Referring to FIG. 2E, it is a conceptual view illustrating the operation of the external reactor vessel cooling and electric power generation system 200 when the power generation system 200 is shut down during a severe accident of a nuclear power plant. As illustrated in the foregoing case of FIG. 2C, the safety systems, such as the passive residual heat removal system, the passive safety injection system, and the passive containment cooling system, including the emergency cooling water storage section 20, which are installed in the plurality of trains, may be automatically operated in response to relative signals.

For example, when a severe accident such as a generation of corium 214' occurs of nuclear accidents, the external reactor vessel cooling section 220 and the power production section 230, which are respectively connected to the evaporation section 290, may be interrupted. Accordingly, the pipe 283 connected to the IRWST 280 may be opened in response to a related signal or by an operator action to supply feedwater from the IRWST 280 so as to cool the lower part of the reactor vessel 210, and the valve 226 installed on the second discharge portion 227 may be opened to discharge generated steam. Depending on characteristics of nuclear power plants, the feedwater may be forcibly injected by installing a pump (not shown) in the pipe 283 connected to the IRWST 280 or may be injected using gravity.

Furthermore, even in case where a severe accident such as damage to the reactor vessel or exposure of the reactor core 214 has occurred of nuclear accidents, in addition to the generation of the corium 214' in the reactor, when the operation of the external reactor vessel cooling section 220 and the power production section 230 is stopped, the injection of feedwater through the IRWST 280 and the opening of the valve 226 connected to the second discharge portion 127 may be enabled in terms of protection.

FIGS. 3A through 3E are conceptual views of an external reactor vessel cooling and electric power generation system in accordance with another embodiment of the present invention.

Figure 3A:
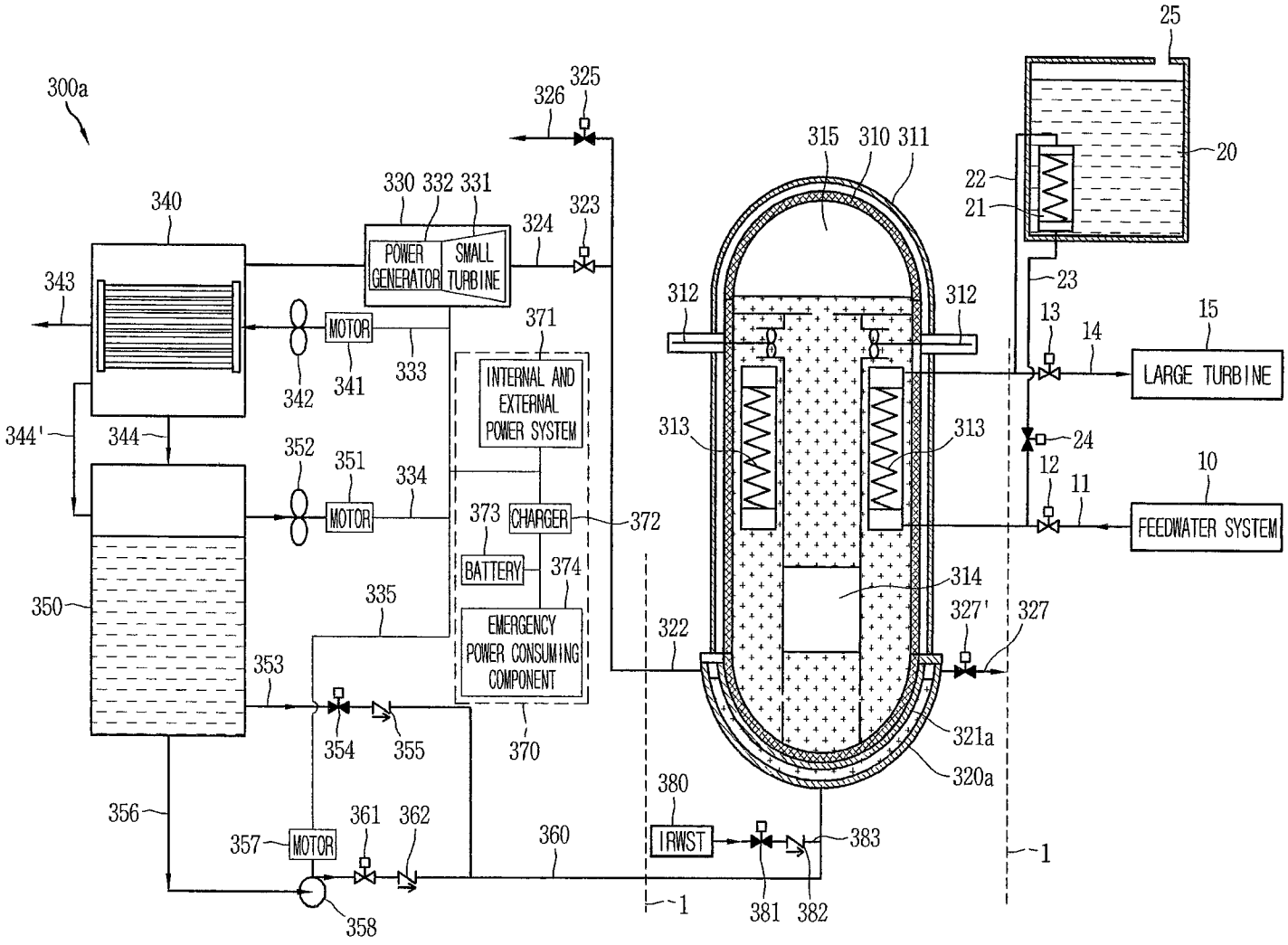
FIGS. 3A through 3E are conceptual views of an external reactor vessel cooling and electric power generation system in accordance with another embodiment of the present invention.

Referring to FIG. 3A, an external reactor vessel cooling section 320*a* of an external reactor vessel cooling and electric power generation system 300*a* may have a hemispherical shape. In addition, the external reactor vessel cooling section 320*a* may further include a coating member 321*a* for preventing corrosion thereof. In this embodiment, the coating member 321*a* may have a surface modified in various ways and may be processed into an uneven shape (cooling fins) to increase a heat transfer surface area. Further, the coating member 321 may further include a heat transfer member (not shown) whose surface is chemically processed to increase a surface area so as to improve heat transfer efficiency. That is, the surfaces of the coating member 321 and the heat transfer member may be chemically processed to increase the surface areas thereof, such that the heat transfer can be efficiently carried out.

Figure 3B:
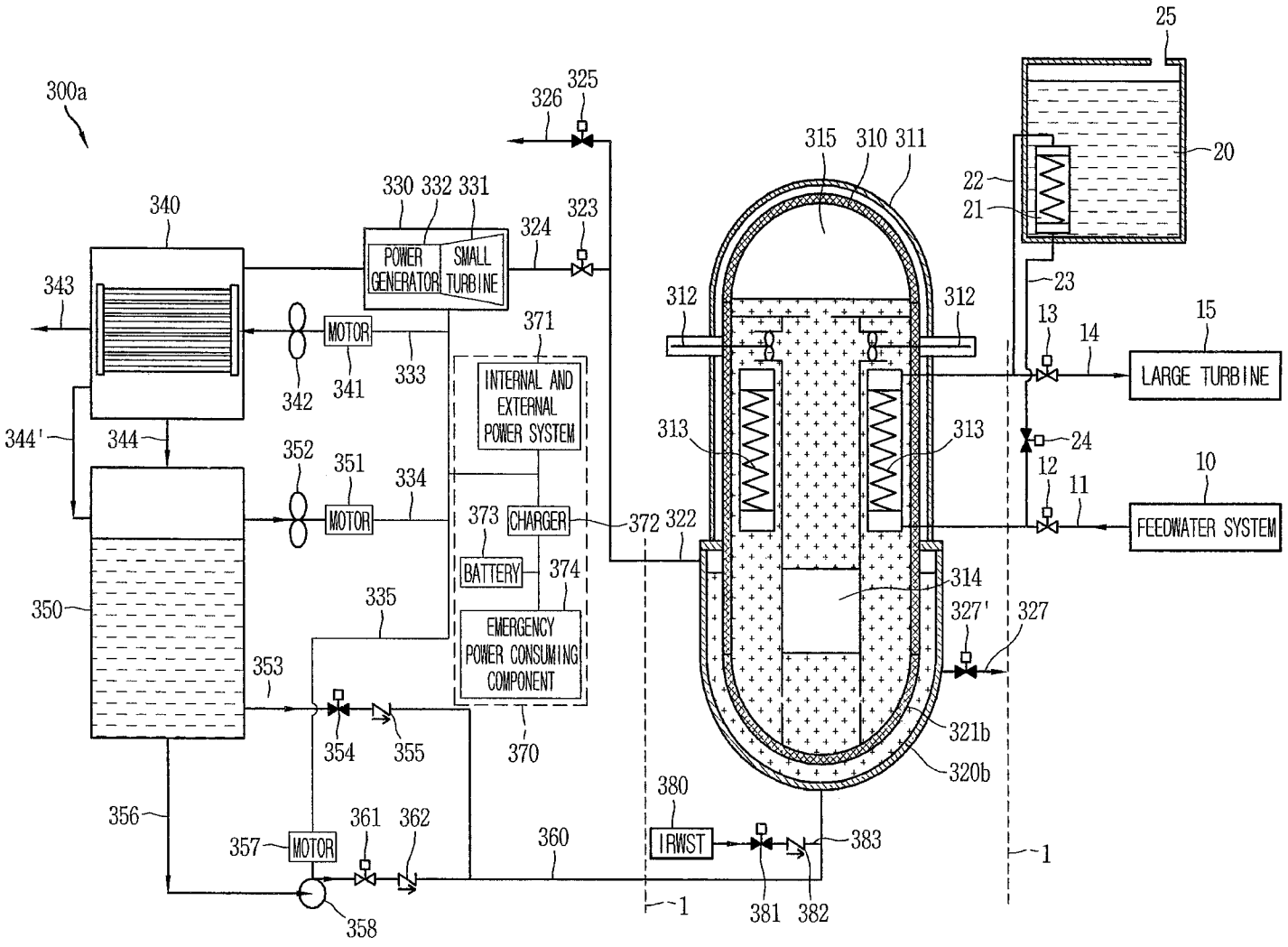

Referring to FIG. 3B, an external reactor vessel cooling section 320*b* of an external reactor vessel cooling and electric power generation system 300*b* may have a mixed shape of a hemispherical shape and a cylindrical shape.

Figure 3C:
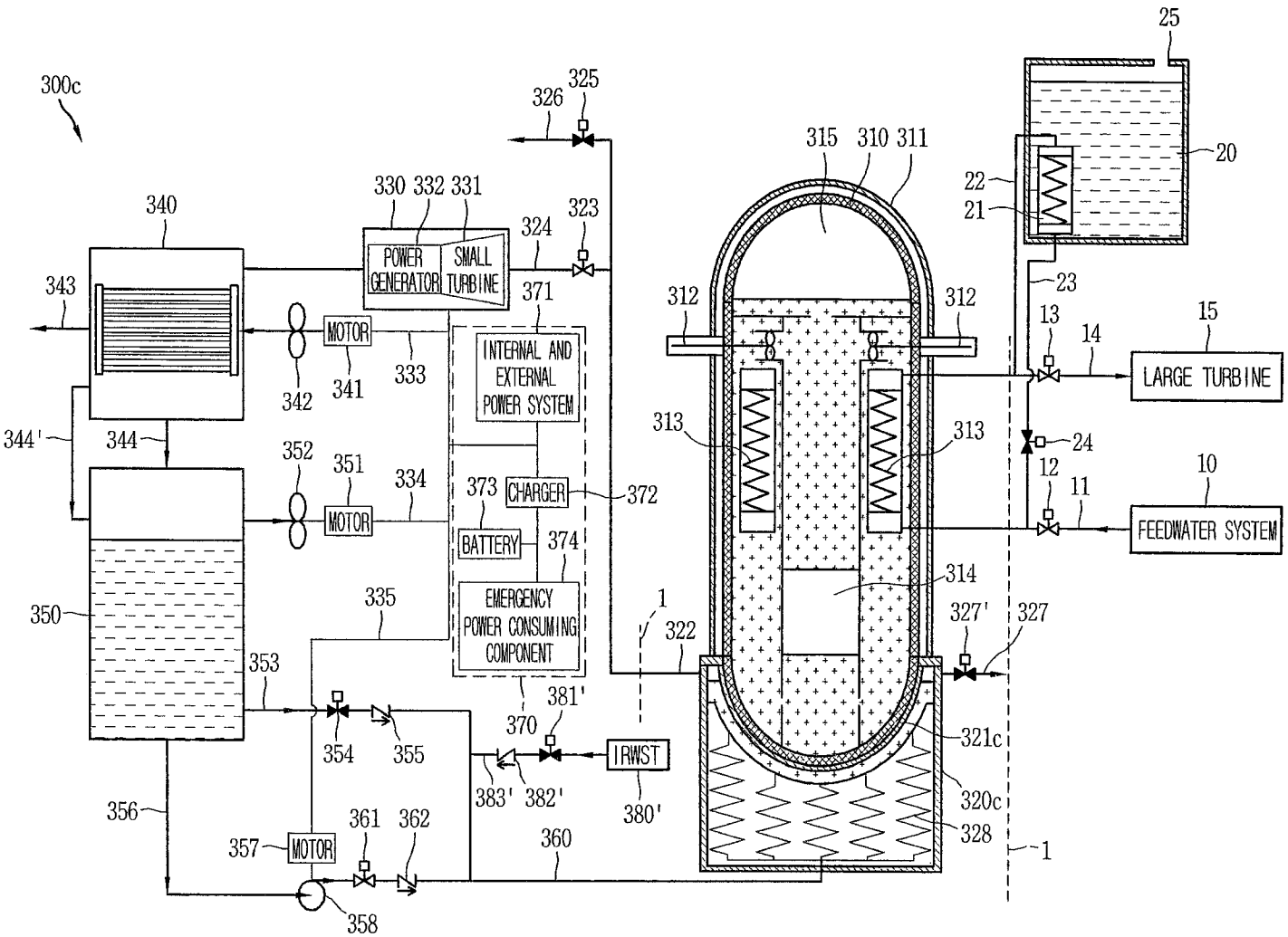

Referring to FIG. 3C, an external reactor vessel cooling and electric power generation system 300*c* may further include a core catcher 328 provided inside an external reactor vessel cooling section 320*c*. The core catcher 328 may receive and cool corium when a reactor vessel 310 is damaged. Further, the external reactor vessel cooling section 320*c* may be connected to an IRWST 380' through a pipe 383' so that nuclear refueling water is supplied. In detail, the IRWST 380' may be connected to a valve 381' and a check valve 382'. In addition, the external reactor vessel cooling section 320*c* may be further provided with a coating member 321*c* for preventing corrosion thereof.

Figure 3D:
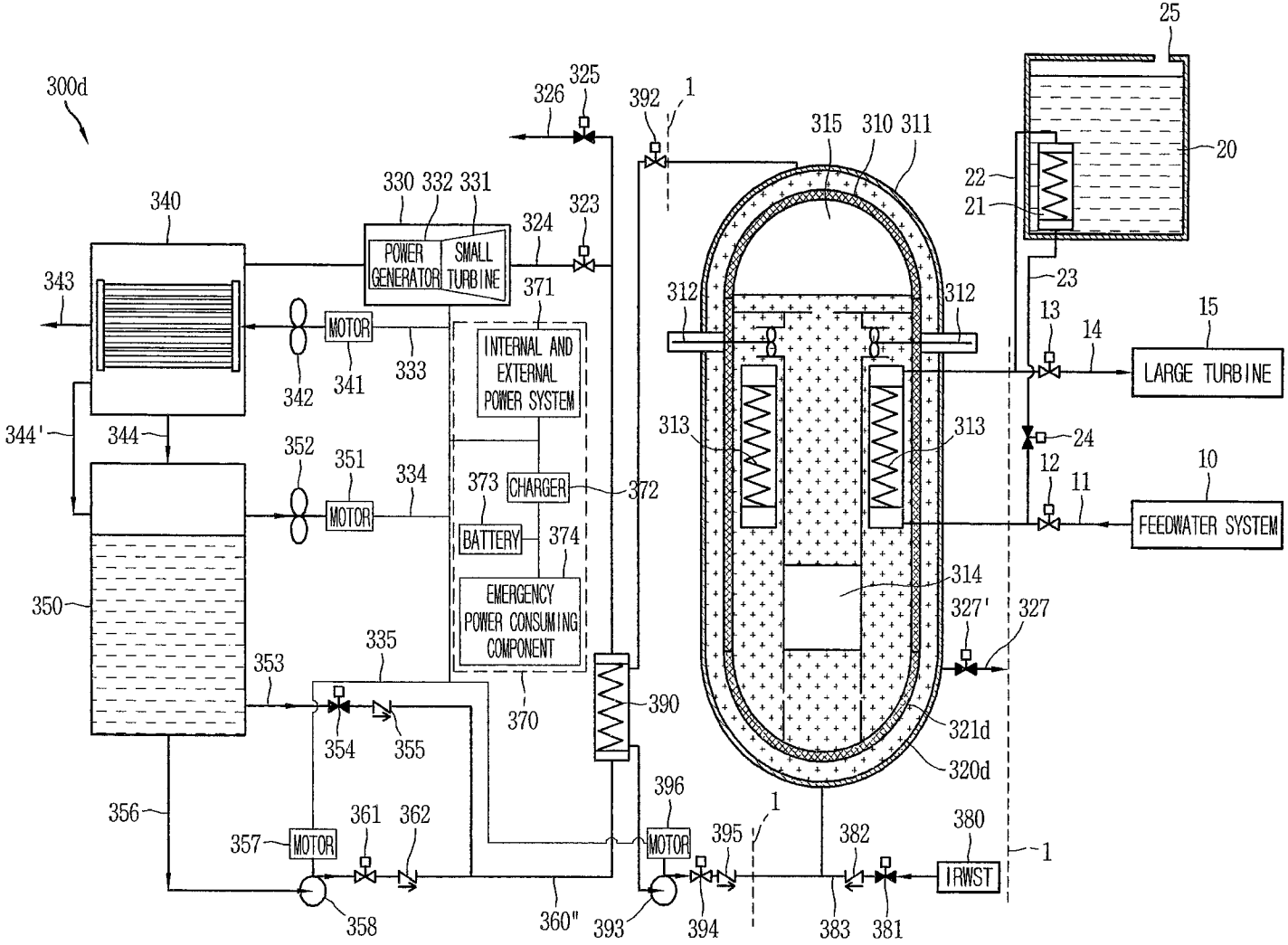

Referring to FIG. 3D, an external reactor vessel cooling section 320*d* in an external reactor vessel cooling and electric power generation system 300*d* may have a shape of a dual vessel such that a cooling vessel (container) covers the entire reactor vessel.

The external reactor vessel cooling and electric power generation system 300*d* may further include an evaporation section 390 connected to the external reactor vessel cooling section 320*d*, similar to the external reactor vessel cooling section 220 of FIG. 2A. The evaporation section 390 may be configured such that a fluid inside the external reactor vessel cooling section 320*d* exchanges heat with condensed water of a condensed water storage section 350. That is, the external reactor vessel cooling and electric power generation system 300*d* may be formed to have a dual circulation loop of a first circulation part and a second circulation part.

Figure 3E:
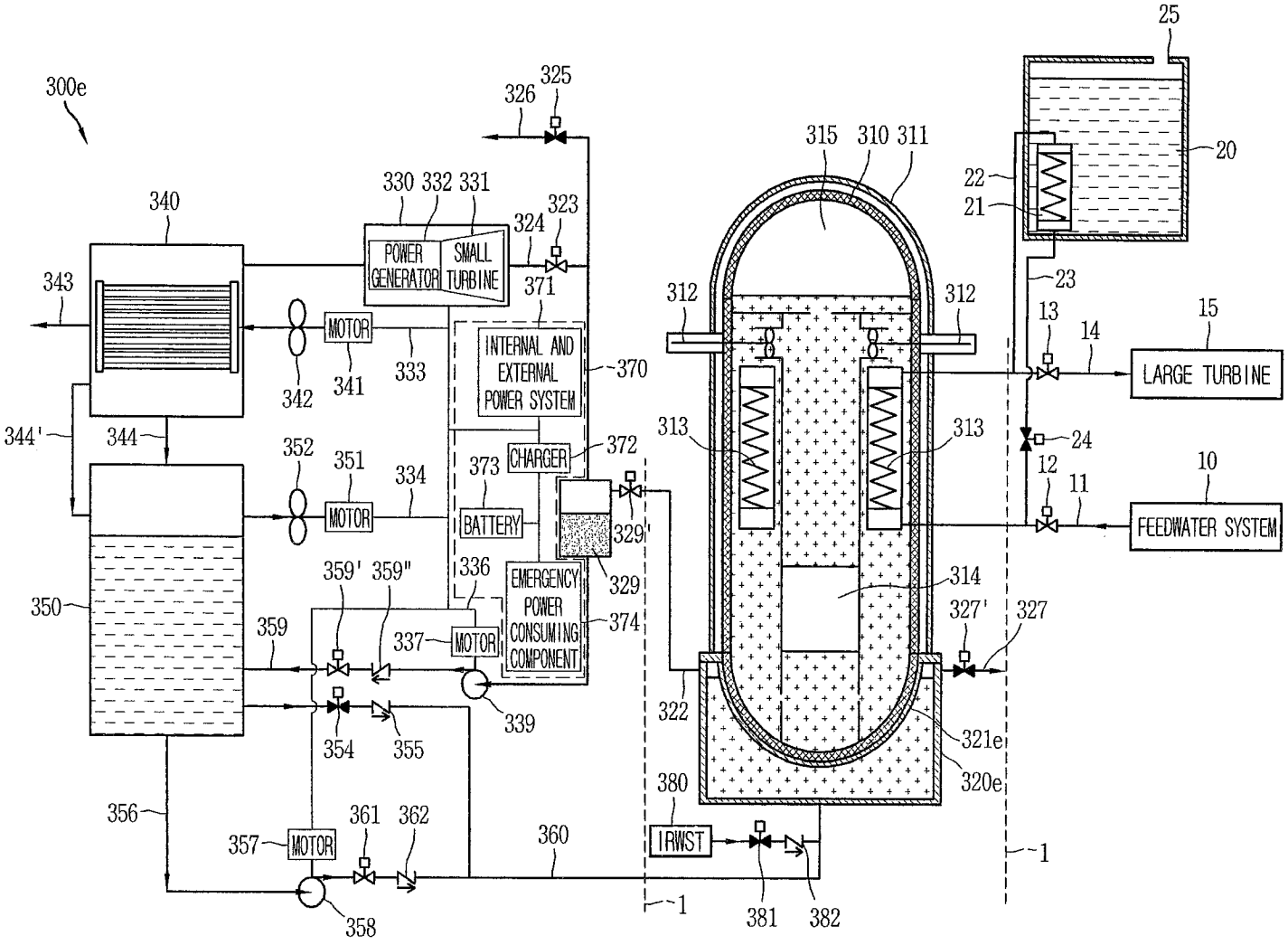

Referring to FIG. 3E, an external reactor vessel cooling and electric power generation system 300*e* may further include a liquid-gas(water-steam) separator 329 connected to a discharge pipe 322. The liquid-gas separator 329 may be configured to transfer only gas in a fluid circulating in the external reactor vessel cooling section 320*e* to a power production section 330. Further, the system 300*e* may further include a cooling water recovery pipe 359 and a pump 339 by which a liquid separated from the liquid-gas separator 329 is transferred into a condensed water storage section 350.

Although those various embodiments of the external reactor vessel cooling and electric power generation system of the present invention have been described above, the present invention may not be limited to the external reactor vessel cooling and electric power generation system and may include a loop or integral type nuclear power plant.

In detail, the loop or integral type nuclear power plant according to the present invention may include a reactor vessel, and an external reactor vessel cooling section that is formed to enclose the reactor vessel to cool an external wall of the reactor vessel using a fluid, which is phase-changed from liquid to gas by receiving heat discharged from the reactor vessel. The nuclear power plant may also include a power production section provided with a small turbine that allows the fluid to move in the external reactor vessel cooling section and generates electric energy using the moved fluid. Further, the nuclear power plant may further include a condensation heat exchange section that causes a heat exchange of the fluid, which is discharged from the small turbine after the generation of the electric energy, and condenses the fluid to generate condensed water. The nuclear power plant may further include a condensed water storage section that collects the condensed water generated in the condensation heat exchange section and allows the condensed water of the condensed water storage section to circulate sequentially through the external reactor vessel cooling section, the power production section and the condensation heat exchange section.

It is obvious to those skilled in the art that the present disclosure can be embodied in other specific forms without departing from the concept and essential characteristics thereof.

The above detailed description should not be limitedly construed and should be considered illustrative in all aspects. The scope of the present invention should be determined by rational interpretation of the appended claims, and all changes within the scope of equivalents of the present invention are included in the scope of the present invention.

What is claimed is:

1. An external reactor vessel cooling and electric power generation system, comprising:

a reactor vessel;

a steam generator disposed inside the reactor vessel and receiving water from a feed water system to produce steam;

an external reactor vessel cooling section formed to enclose at least part of the reactor vessel so as to cool heat discharged from the reactor vessel;

a power production section including a small turbine and a small generator to generate electric power using a fluid that receives heat from the external reactor vessel cooling section;

a condensation heat exchange section to perform a heat exchange of the fluid discharged after operating the small turbine, and condense the fluid to generate condensed water; and a condensed water storage section to collect therein the condensed water generated in the condensation heat exchange section, wherein the fluid receiving the heat from the reactor vessel is circulated, and wherein the steam generator is connected to a large turbine and a large generator to generate electric power, wherein the electric power produced by the power production section has a capacity of less than 1% compared to the electric power produced by the large turbine and the large generator, and wherein the power production section is operated during a normal operation of a nuclear power plant and during an accident of the nuclear power plant to produce electric power.

2. The system of claim 1, wherein the condensed water in the condensed water storage section is circulated through the external reactor vessel cooling section, the power production section, and the condensation heat exchange section, and the condensed water is phase-changed into gas by the heat received from the reactor vessel.

3. The system of claim 1, further comprising:

an evaporation section connected to the external reactor vessel cooling section to cause a heat exchange between a fluid inside the external reactor vessel cooling section and the condensed water of the condensed water storage section, wherein the system further comprises:

a first circulation part defined between the external reactor vessel cooling section and the evaporation section such that the fluid from the external reactor vessel cooling section flows therealong; and a second circulation part provided sequentially along the evaporation section, the power production section, the condensation heat exchange section, and the condensed water storage section, such that the fluid for operating the small turbine flows therealong.

4. The system of claim 3, wherein the first circulation part is circulated by a single-phase fluid.

5. The system of claim 1, wherein the electric power produced during the normal operation of the nuclear power plant is supplied to an internal/external electric power system and an emergency power source.

6. The system of claim 5, wherein the electric power charged in the emergency power source is supplied as emergency power during the accident of the nuclear power plant.

7. The system of claim 1, wherein the electric power produced during the accident of the nuclear power plant is supplied as emergency power of the nuclear power plant.

8. The system of claim 6 or 7, wherein the emergency power is supplied as power for operating a safety system of the nuclear power plant during the accident of the nuclear power plant, opening and closing a valve for the operation of the safety system, monitoring the safety system, or operating the external reactor vessel cooling and electric power generation system.

9. The system of claim 1, wherein seismic design of seismic categories I, II or III is applied.

10. The system of claim 1, wherein safety classes 1, 2 or 3 are applied.

11. The system of claim 1, wherein the external reactor vessel cooling section is provided with a discharge pipe that connects the external reactor vessel cooling section and the power production section to each other such that the fluid of the external reactor vessel cooling section is applied to the power production section.

12. The system of claim 11, wherein the discharge pipe is provided with a first discharge portion through which at least part of the fluid excessively supplied to the power production section bypasses the small turbine and the small generator.

13. The system of claim 11, wherein the discharge pipe is further provided with a liquid gas separator that is connected to the discharge pipe such that only gas of the fluid is transferred to the power production section.

14. The system of claim 1, wherein the condensation heat exchange section is provided with a motor or pump that supplies a cooling fluid to the condensation heat exchange section to exchange heat with the fluid.

15. The system of claim 14, wherein the cooling fluid comprises air, pure water, seawater, or a mixture thereof.

16. The system of claim 1, wherein the condensed water storage section is disposed below the condensation heat exchange section to collect the condensed water generated in the condensation heat exchange section.

17. The system of claim 16, wherein the condensed water storage section is connected to the external reactor vessel cooling section through a pipe so that the condensed water is supplied to the external reactor vessel cooling section.

18. The system of claim 1, wherein the condensation heat exchange section or the condensed water storage section is provided with a vent portion through which non-condensable gas accumulated in the condensation heat exchange section or in the condensed water storage section is removed.

19. The system of claim 1, wherein at least part of a shape of the external reactor vessel cooling section includes a cylindrical shape, a hemispherical shape, and a double vessel shape, or a combination thereof.

20. The system of claim 1, wherein a pipe is connected to an in-containment refueling water storage tank (IRWST) such that refueling water is supplied to the external reactor vessel cooling section.

21. The system of claim 20, wherein the external reactor vessel cooling section is provided with a second discharge portion through which the refueling water supplied from the IRWST is discharged.

22. The system of claim 1, wherein a coating member is further provided to prevent corrosion of the reactor vessel.

23. The system of claim 22, wherein a surface of the coating member is chemically processed to increase a surface area.

24. The system of claim 1, further comprising a heat transfer member to smoothly transfer heat discharged from the reactor vessel.

25. The system of claim 24, wherein a surface of the heat transfer member is chemically processed to increase a surface area.

26. The system of claim 1, further comprising a core catcher provided inside the external reactor vessel cooling section to receive and cool corium when the reactor vessel is damaged.

* * * * *